US012680749B2

(12) United States Patent
Gaffet et al.

(10) Patent No.: US 12,680,749 B2
(45) Date of Patent: Jul. 14, 2026

(54) EASY ACCESS VIA A PARTIAL LATERAL OPENING SYSTEM

(71) Applicant: L'AIR LIQUIDE, SOCIETE ANONYME POUR L'ETUDE ET L'EXPLOITATION DES PROCEDES GEORGES CLAUDE, Paris (FR)

(72) Inventors: Luc Gaffet, Sassenage (FR); Olivier Guia, Sassenage (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 338 days.

(21) Appl. No.: 18/282,441

(22) PCT Filed: Mar. 7, 2022

(86) PCT No.: PCT/EP2022/055700
§ 371 (c)(1),
(2) Date: Sep. 15, 2023

(87) PCT Pub. No.: WO2022/194589
PCT Pub. Date: Sep. 22, 2022

(65) Prior Publication Data

US 2024/0159450 A1 May 16, 2024

(30) Foreign Application Priority Data

Mar. 16, 2021 (FR) ..... 2102583
Nov. 19, 2021 (FR) ..... 2112248

(51) Int. Cl.
*F25D 23/02* (2006.01)
*F25D 3/10* (2006.01)

(52) U.S. Cl.
CPC ..... *F25D 23/02* (2013.01); *F25D 3/102* (2013.01)

(58) Field of Classification Search
CPC ..... F25D 23/02; F25D 25/00; F25D 3/102; F25D 19/006
See application file for complete search history.

(56) References Cited

U.S. PATENT DOCUMENTS 4,297,856 A 11/1981 Staas et al.
4,498,046 A 2/1985 Faris et al.
(Continued)

OTHER PUBLICATIONS

International Search Report and Written Report for PCT/EP2022/055700, mailed Jun. 22, 2022.
(Continued)

*Primary Examiner* — Filip Zec
(74) *Attorney, Agent, or Firm* — Justin K. Murray

(57) ABSTRACT

Refrigeration system comprising: a first cryogenic chamber defined by at least a first wall, the first cryogenic chamber being thermally connected to at least a first cold source; a second cryogenic chamber defined by at least a second wall which extends at least partially facing the first wall, the second chamber being contained inside the first chamber and thermally connected to at least a second cold source; wherein the refrigeration system comprises at least a first door made in the first wall substantially facing a second door made in the second wall, the first door and the second door being arranged in such a way that the opening of the first door allows the opening of the second door.

38 Claims, 19 Drawing Sheets

(56) References Cited

U.S. PATENT DOCUMENTS

| | | | | |
|---|---|---|---|---|
| 4,707,998 | A | 11/1987 | Linner et al. | |
| 4,827,736 | A * | 5/1989 | Miura | F25D 19/006 62/51.1 |
| 5,365,743 | A | 11/1994 | Nagao et al. | |
| 5,842,348 | A * | 12/1998 | Kaneko | F25D 19/006 62/51.1 |
| 5,960,868 | A * | 10/1999 | Kuriyama | F25D 19/006 165/277 |
| 7,197,884 | B2 | 4/2007 | Jones et al. | |
| 7,310,954 | B2 | 12/2007 | Miki | |
| 8,128,740 | B2 | 3/2012 | Wright et al. | |
| 9,230,724 | B2 * | 1/2016 | Harrison | F25D 19/00 |
| 9,552,906 | B1 * | 1/2017 | Mine | H01F 6/065 |
| 9,709,313 | B2 * | 7/2017 | Miki | F25B 9/14 |
| 10,145,602 | B2 * | 12/2018 | Shirron | F25D 19/006 |
| 10,258,253 | B2 * | 4/2019 | Garside | F25B 9/10 |
| 10,490,329 | B2 * | 11/2019 | Eguchi | H01F 6/02 |
| 10,839,998 | B2 * | 11/2020 | Wikus | H01F 6/065 |
| 11,333,404 | B2 * | 5/2022 | Matthews | F25D 19/006 |
| 11,508,506 | B2 * | 11/2022 | Urbahn | G01R 33/3815 |
| 12,073,991 | B2 * | 8/2024 | Demura | H01F 6/065 |
| 2004/0065108 | A1 * | 4/2004 | Fjaestad | F25B 39/02 62/407 |
| 2012/0031110 | A1 * | 2/2012 | Tanaka | F25D 19/006 62/51.1 |
| 2012/0060520 | A1 * | 3/2012 | Collins | G01N 35/04 62/62 |
| 2012/0094840 | A1 * | 4/2012 | Tanaka | H01F 6/04 505/211 |
| 2014/0007596 | A1 | 1/2014 | Prester et al. | |
| 2018/0202908 | A1 * | 7/2018 | Croquette | G01N 1/42 |
| 2019/0383525 | A1 | 12/2019 | Matthews et al. | |
| 2021/0025624 | A1 * | 1/2021 | Li | F25B 9/08 |
| 2023/0088083 | A1 * | 3/2023 | Matthews | F25D 19/006 62/610 |

OTHER PUBLICATIONS

French Search Report for FR 2 102 583, mailed Nov. 30, 2021.
French Search Report for FR 2 112 248, mailed Jul. 4, 2022.

* cited by examiner

[Fig. 1]
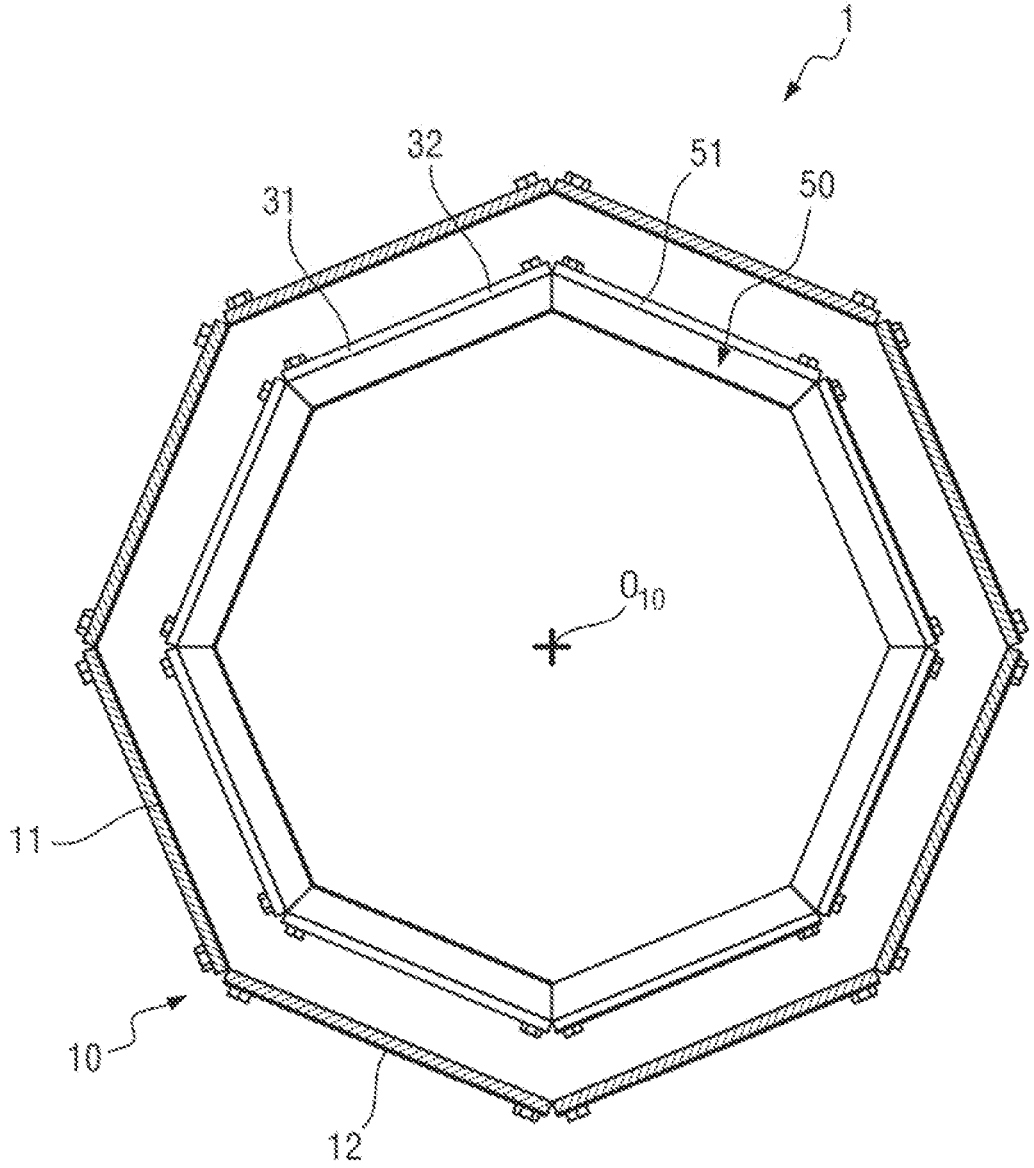

[Fig. 2]
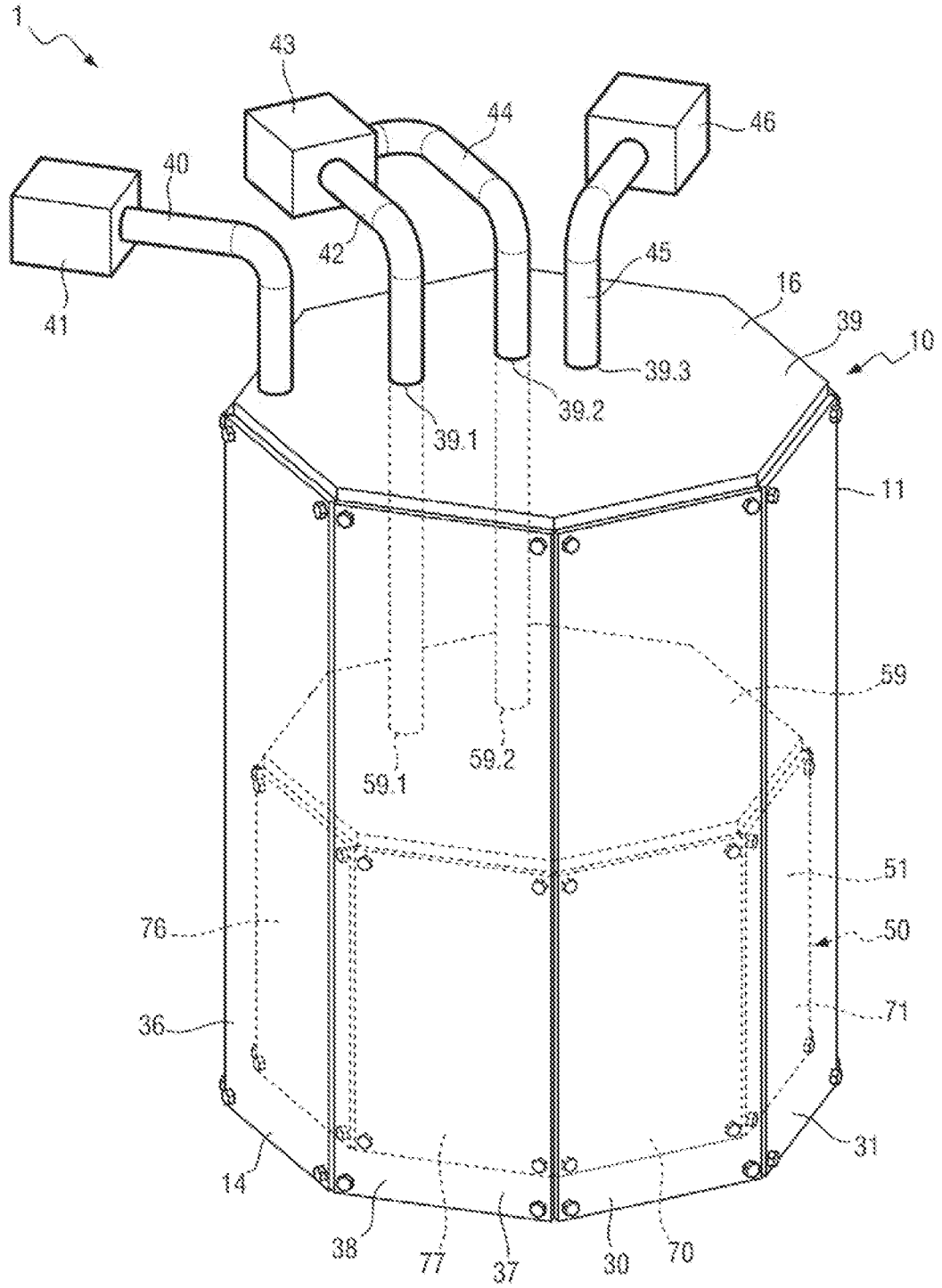

[Fig. 3]
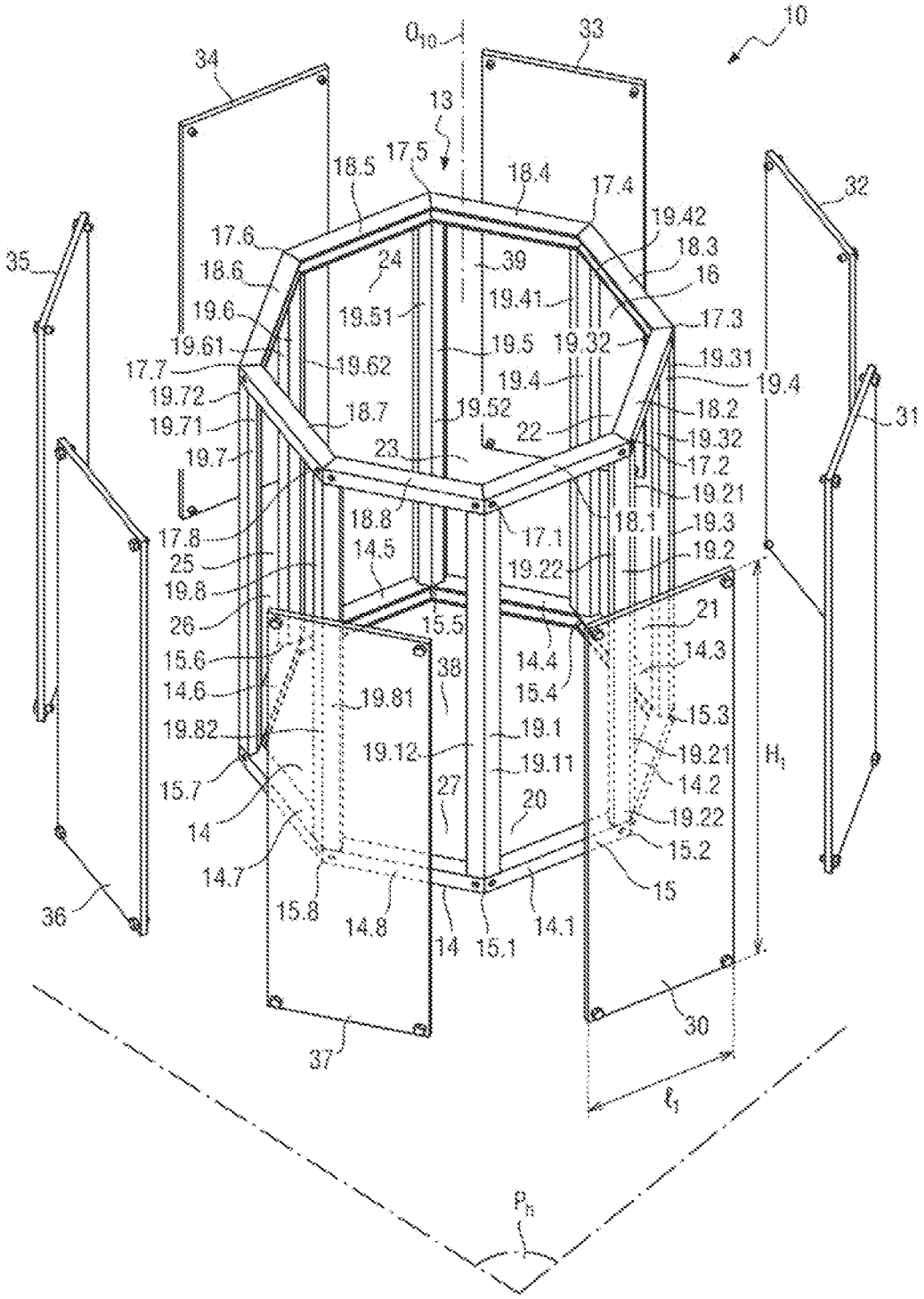

[Fig. 4]
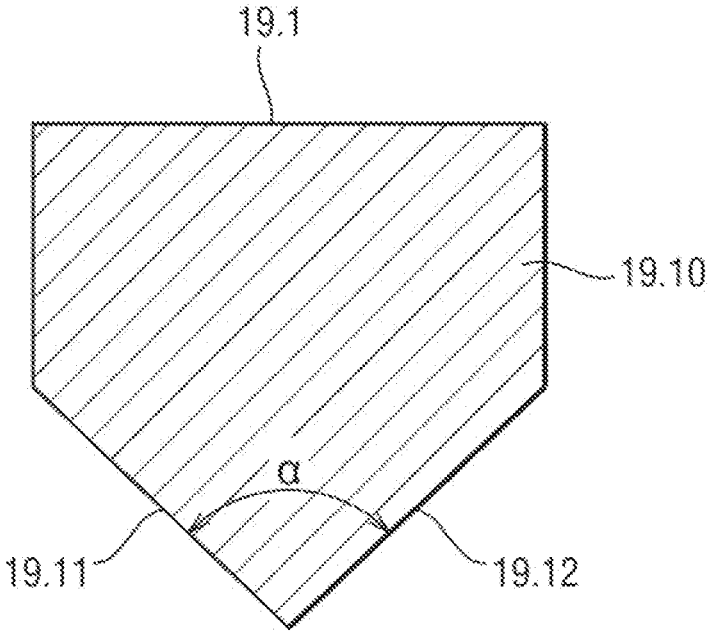

[Fig. 5]
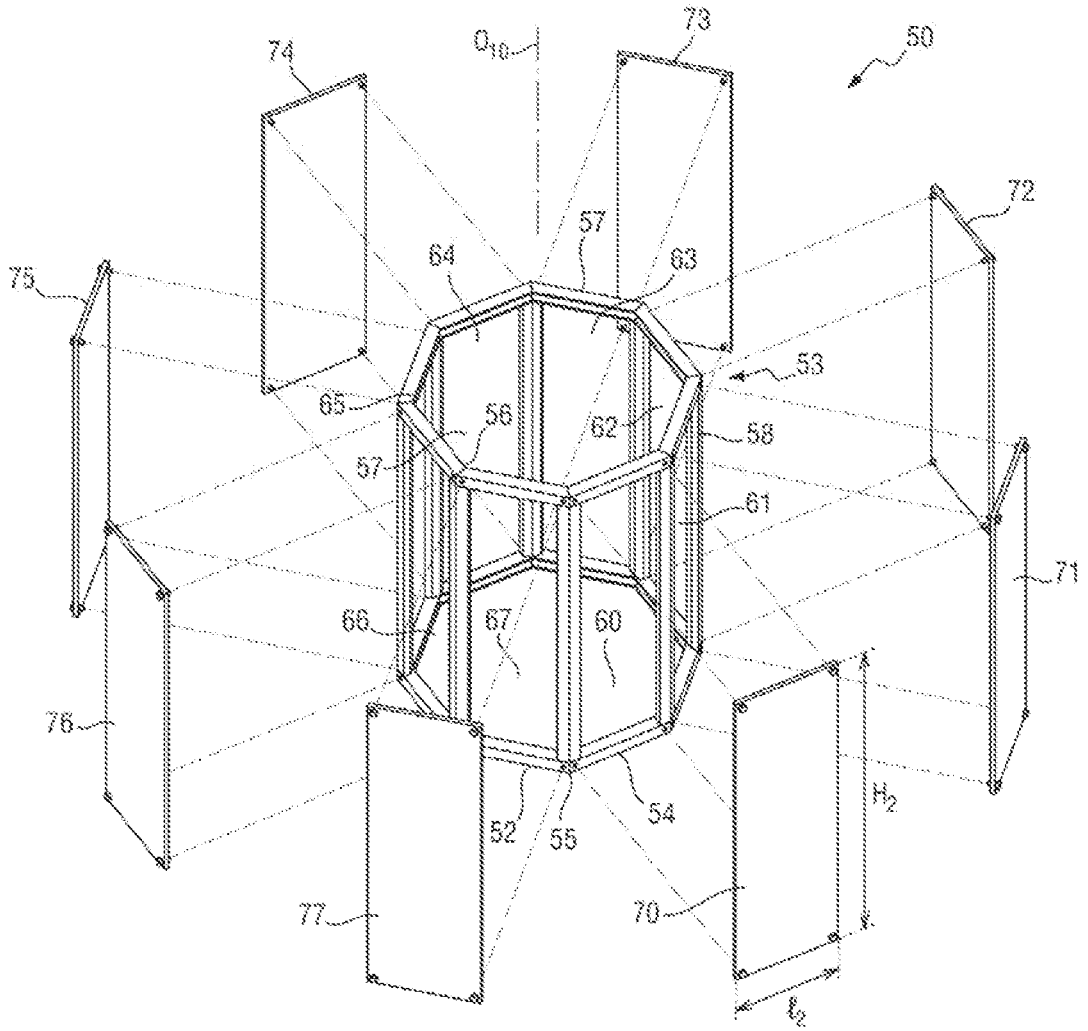

[Fig. 6]
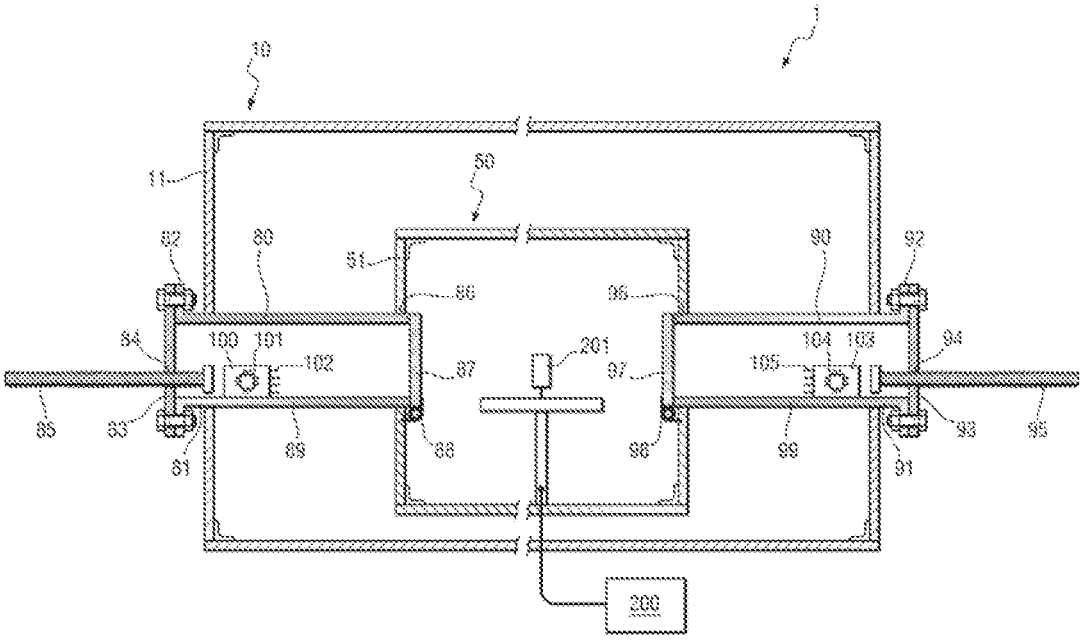

[Fig. 7]
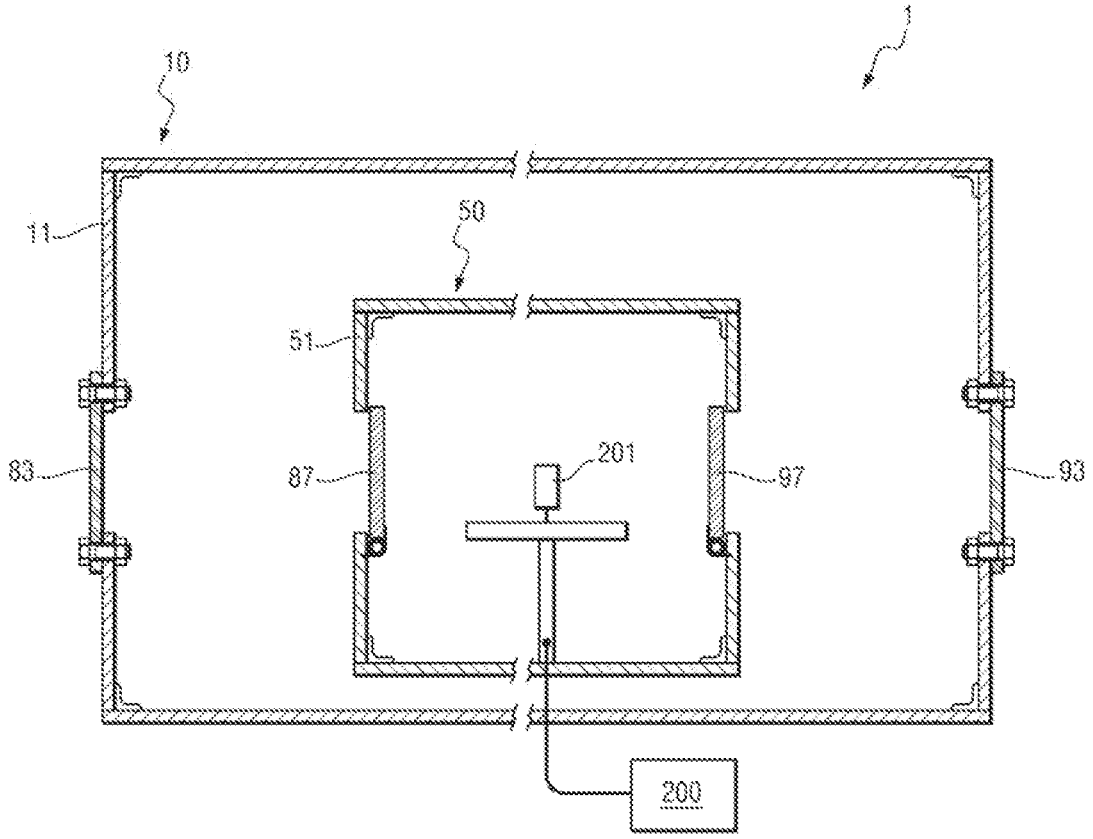

[Fig. 8]
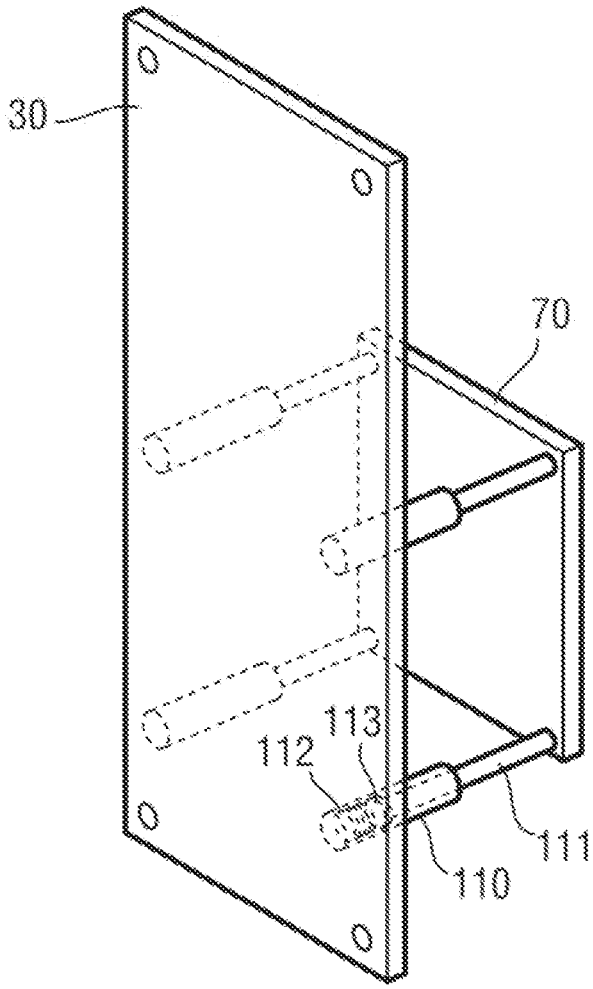

[Fig. 9]
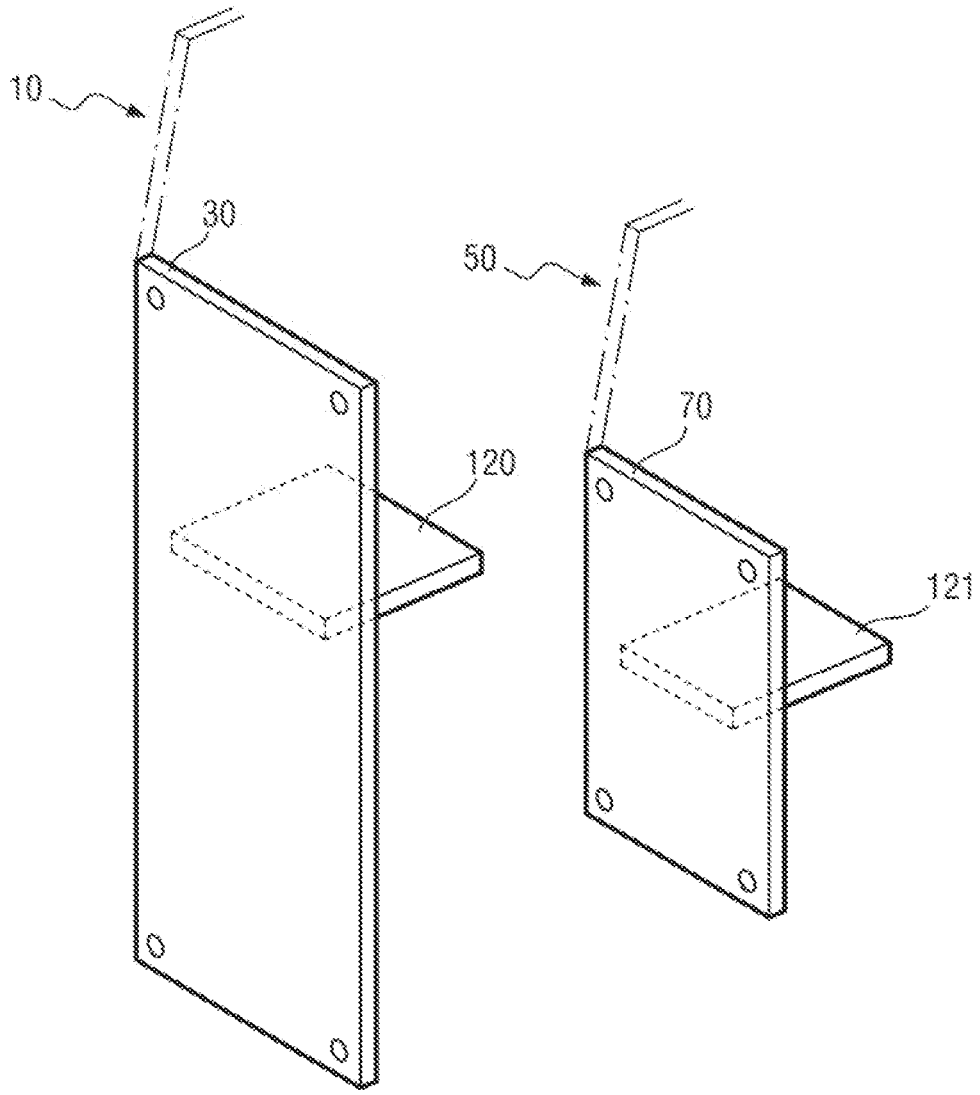

[Fig. 10]
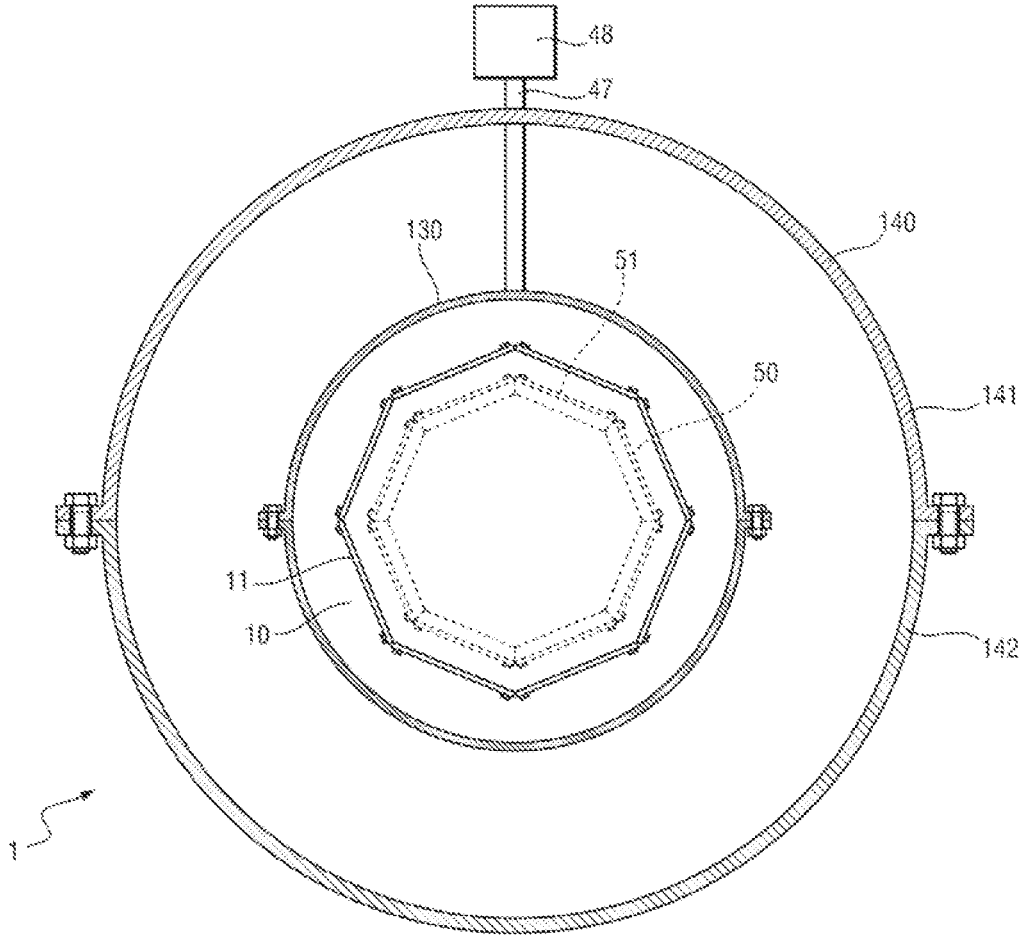

[Fig. 11]
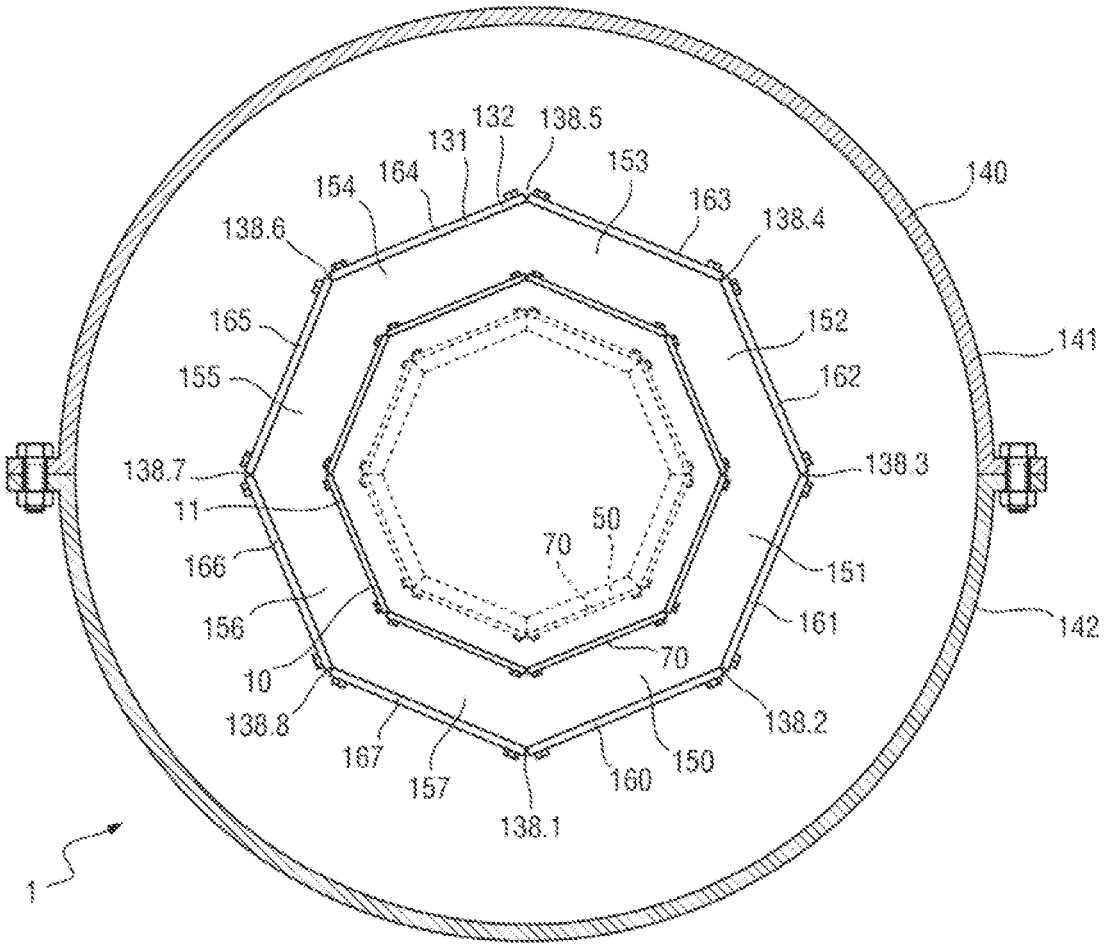

[Fig. 12]
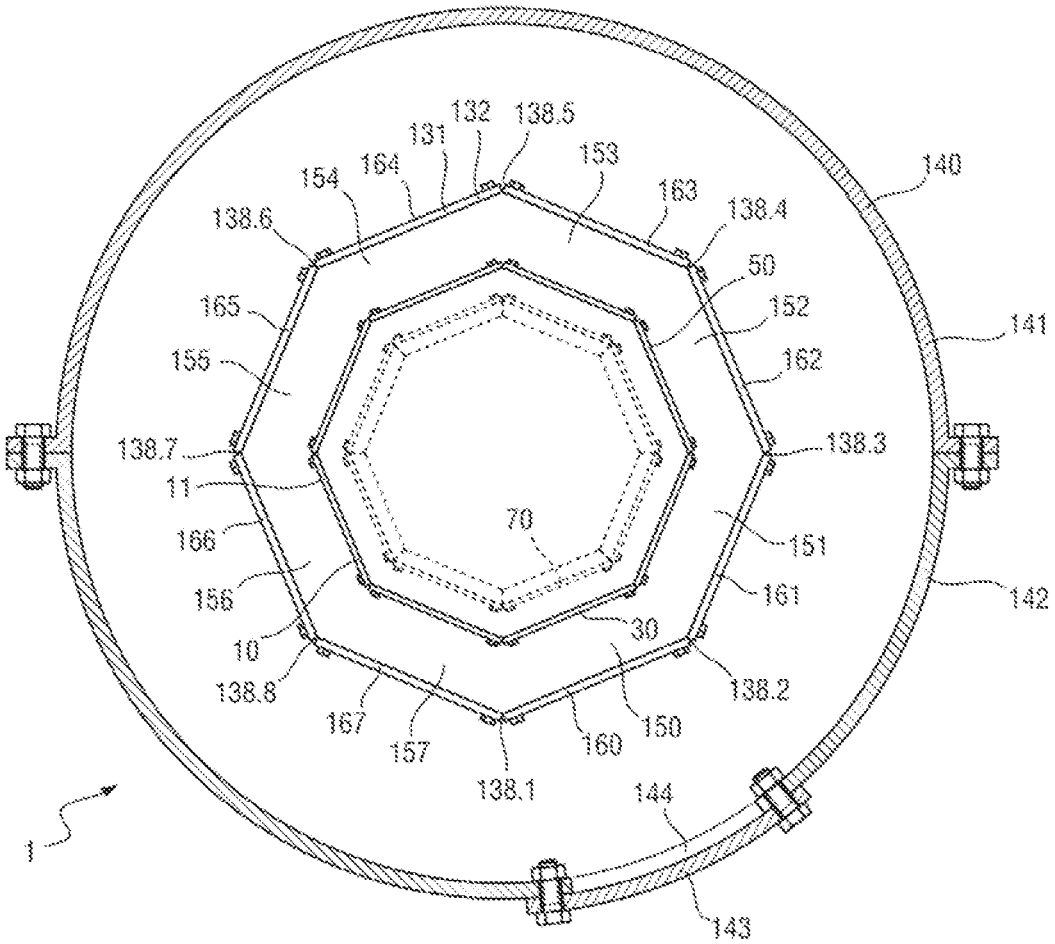

[Fig. 13]
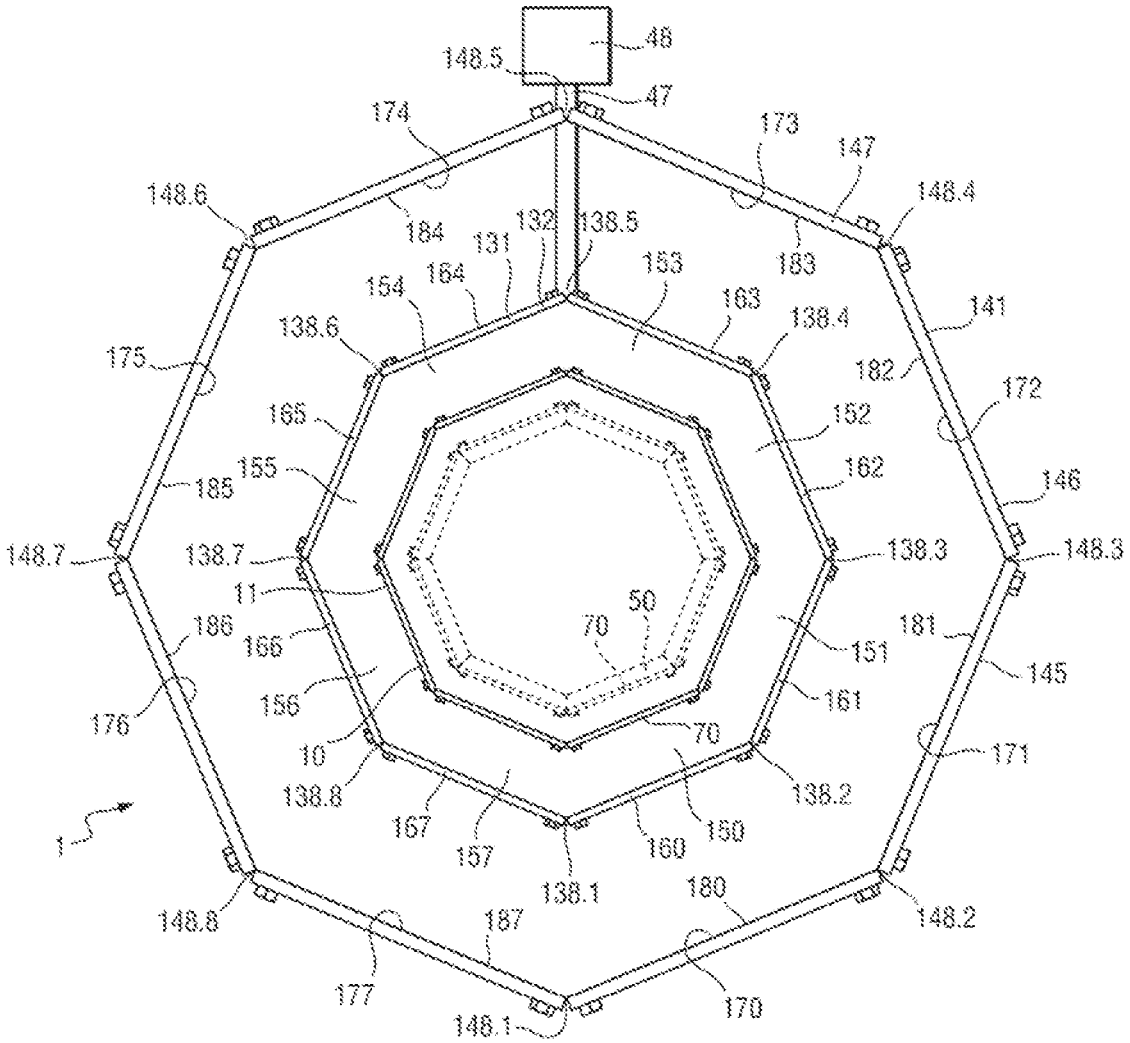

[Fig. 14]
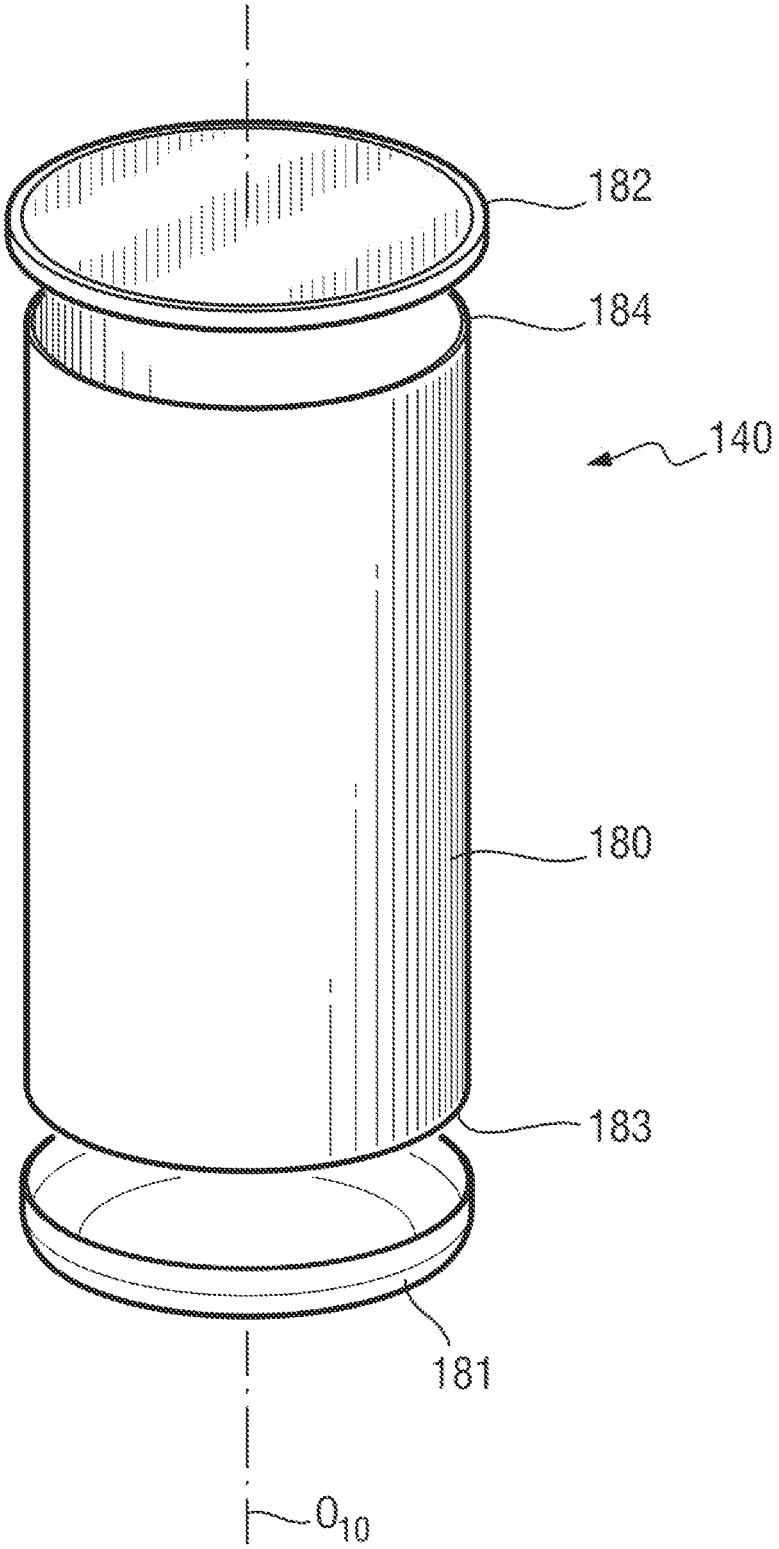

[Fig. 15]
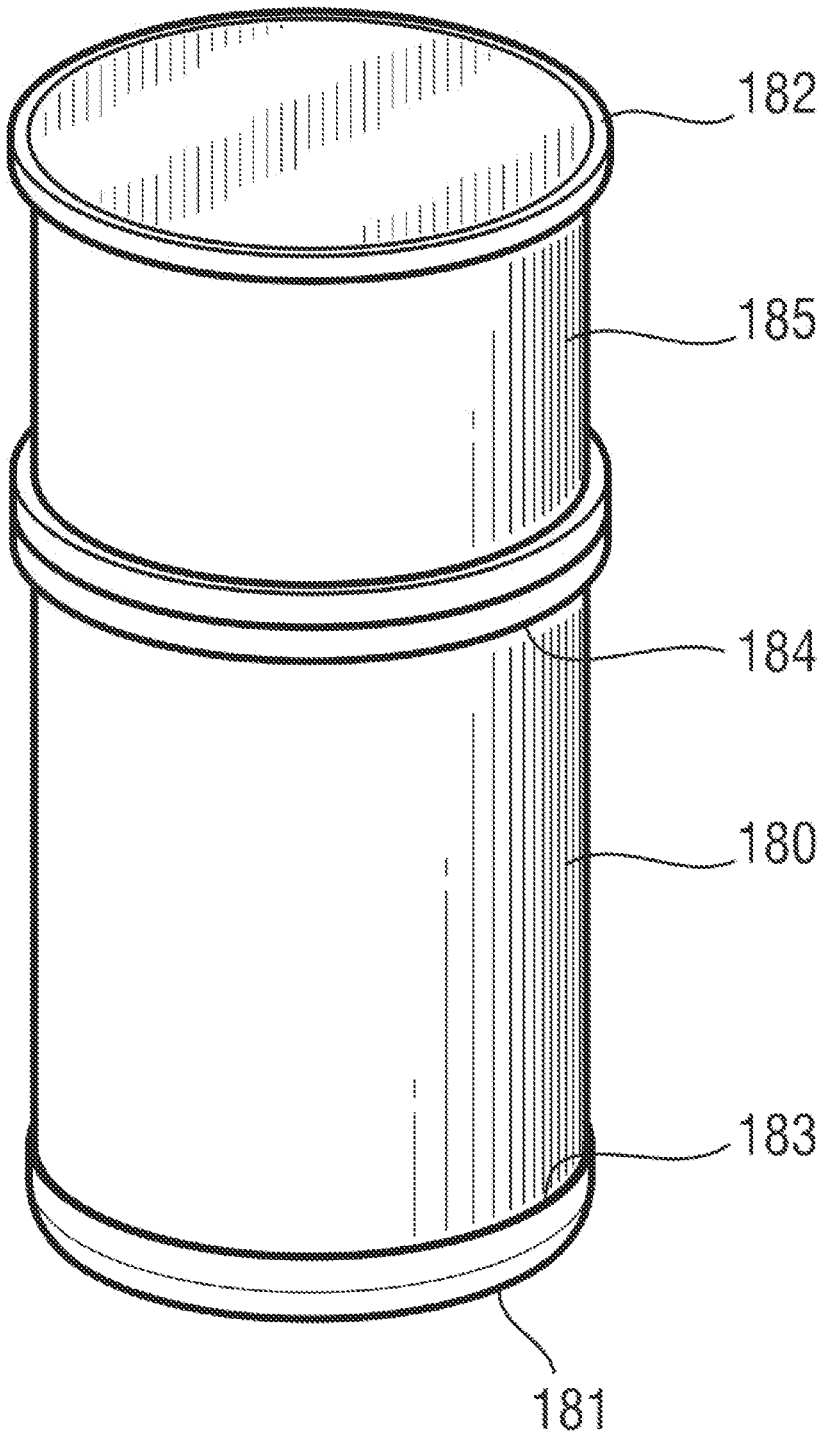

[Fig. 16]
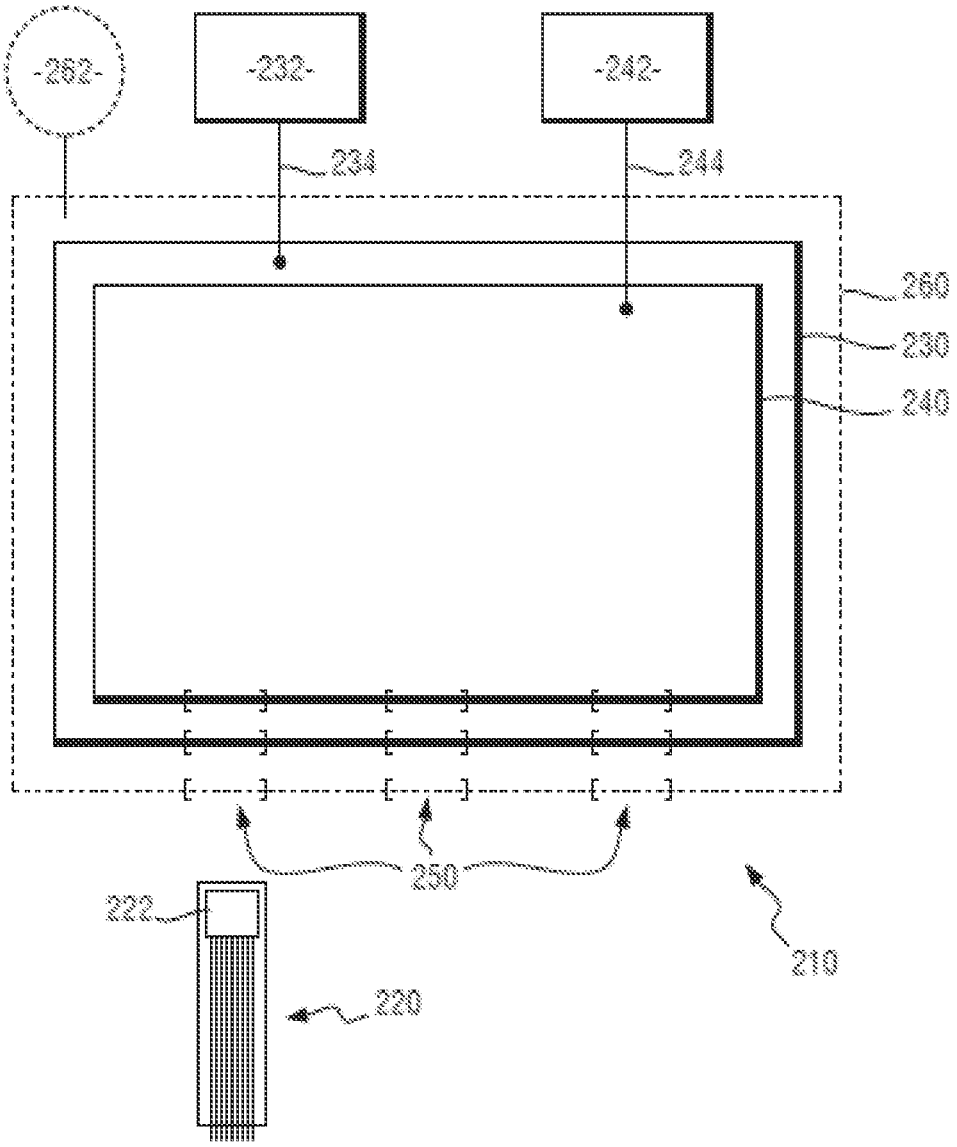

[Fig. 17]
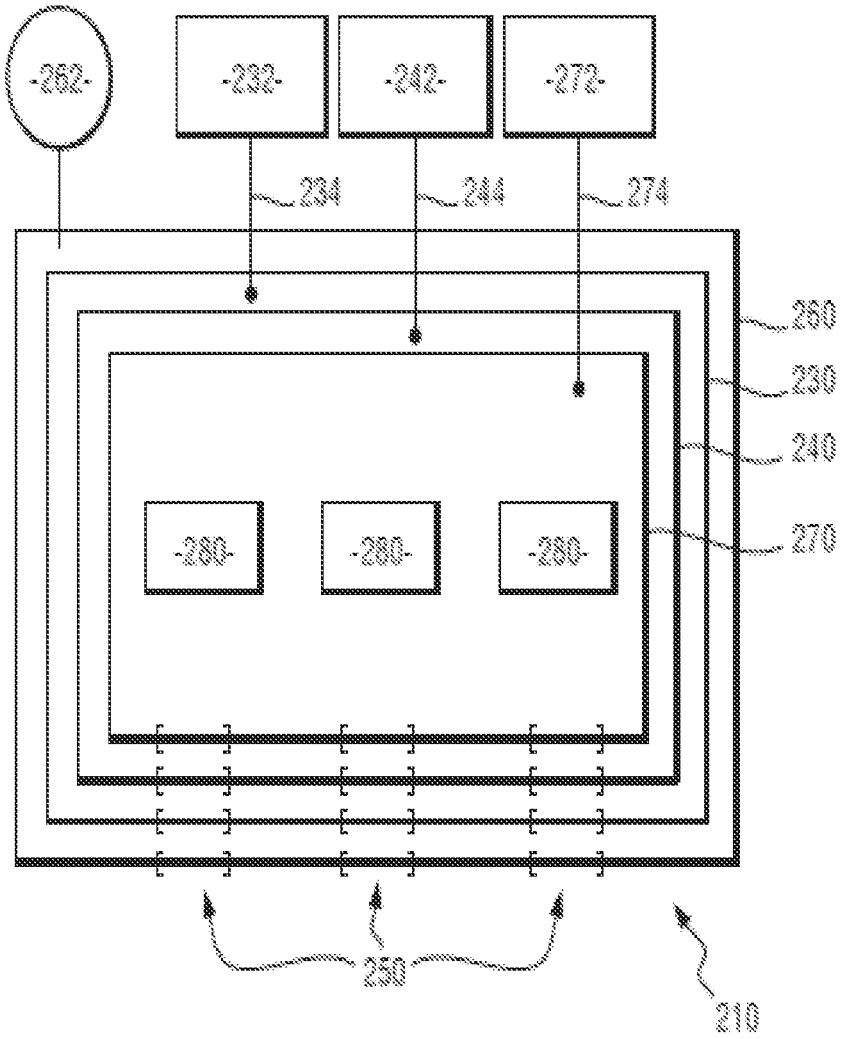

[Fig. 18]
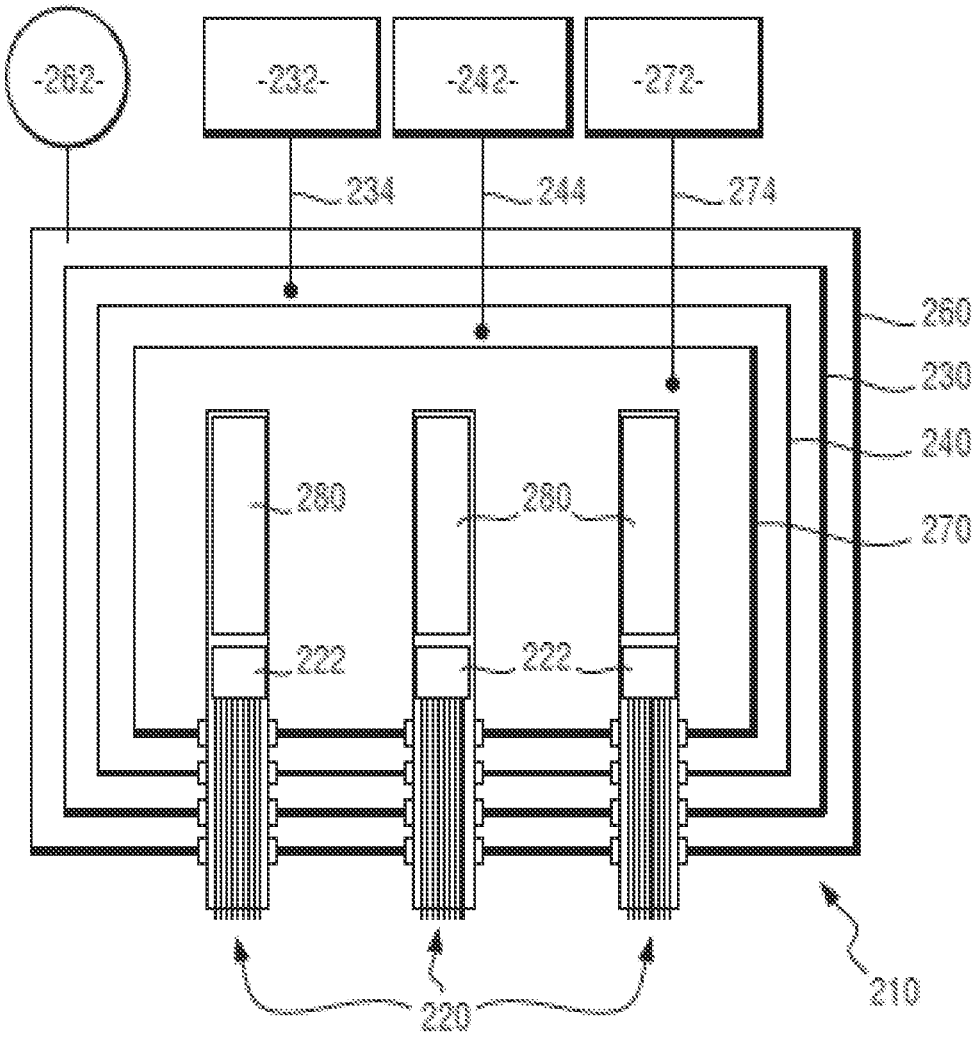

[Fig. 19]
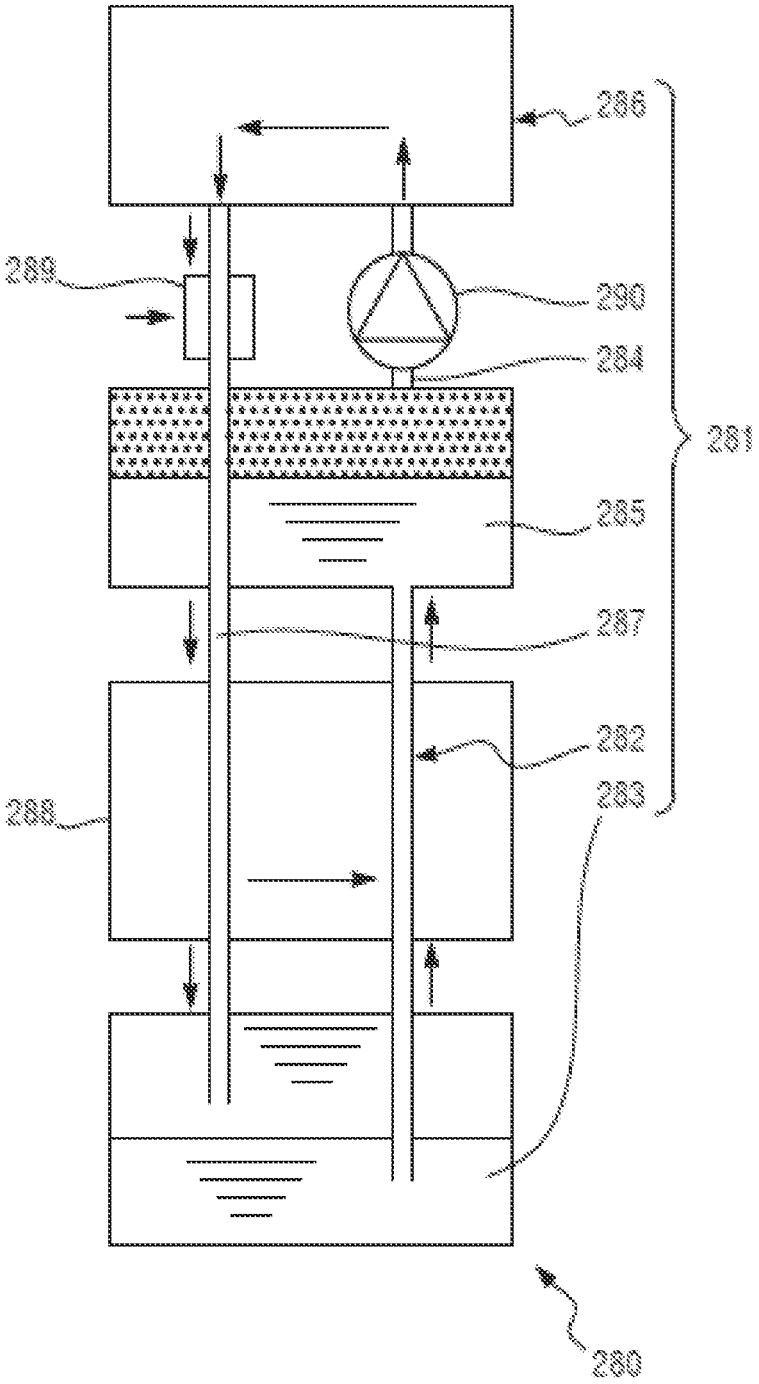

EASY ACCESS VIA A PARTIAL LATERAL OPENING SYSTEM

CROSS REFERENCE TO RELATED APPLICATIONS

This application is a § 371 of International PCT Application PCT/EP2022/055700, filed Mar. 7, 2022, which claims the benefit of FR2102583, filed Mar. 16, 2021, and FR2112248, filed Nov. 19, 2021, all of which are herein incorporated by reference in their entireties.

FIELD OF THE INVENTION

The present invention concerns the field of refrigeration at very low temperatures, and more particularly the field of refrigeration systems at temperatures close to a few degrees Kelvin, and refrigeration systems at temperatures below Kelvin, and in particular close to ten millikelvin.

BACKGROUND OF THE INVENTION

Conventionally, a refrigeration system at very low temperature comprises a first cryogenic enclosure defined by at least one first wall, and a second cryogenic enclosure contained inside the first enclosure and defined by at least one second wall which extends at least partially facing the first wall. The first cryogenic enclosure is thermally connected to a first cold source, and the second cryogenic enclosure is thermally connected to a second cold source.

Generally, the first wall and the second wall are cylindrical and constructed similarly. Thus the first enclosure comprises two first half-cylinders connected in a first longitudinal direction, and the second enclosure comprises two second half-cylinders connected in a second longitudinal direction, generally parallel to the first.

Access to the interior of the system and in particular to the coldest zone of the system for the purpose of maintenance or to install an item to be cooled (e.g. a quantum chip, a sensor, a superconductor element, a scanning tunneling microscope (STM) or other object to be cooled), requires the removal of at least one of the first half-cylinders and one of the second half-cylinders. These operations use costly lifting means to perform hazardous handling of heavy elements. Such operations also involve a particularly long stoppage of the refrigeration system, which penalizes its operation.

Quantum computing is a relatively complex application currently in development. The emergence of the quantum computer, the core of which functions in an environment characterized by low or ultra-low temperatures, poses the problem of generation and distribution of cold within an industrial architecture compatible with the constraints of operation of a computing system. The term low or ultra-low temperatures means temperatures potentially in the region of one millikelvin to around a hundred millikelvin.

Refrigeration at temperatures lower than around 100 millikelvin is used for the most part in applications for studying matter and quantum phenomena, for the production of electromagnetic radiation detectors.

Quantum phenomena give rise to theoretical and technological developments that are capable of using them to carry out operations ("quantum computing") for the development of supercomputers (which carry out for example a billion billion calculations per second) by manipulating superconducting "qubits" at temperatures close to one millikelvin or based on silicon at several hundred millikelvin.

Generally, these applications use dilution refrigerators for cooling purposes, allowing them to manipulate around 100 qubits and integrate the hundreds of wired and coaxial connections (around four per qubit) that are necessary for controlling them and reading their status.

Thus, the traditional means of obtaining the refrigeration power to temperatures of around one millikelvin to around one hundred or several hundred millikelvin is the helium-3 and helium-4 dilution refrigerator.

Other technologies afford cooling powers of 8 to 30 microwatts at 20 mK or 250 to 1000 microwatts at 100 mK.

The existing solutions are no longer suitable for ultimately manipulating tens of thousands and up to millions of qubits in a quantum computer.

SUMMARY OF THE INVENTION

The object of the invention is to reduce the costs and/or time for maintenance and/or installation of equipment to be cooled inside a low-temperature refrigeration system.

In certain embodiments of the invention, a refrigeration system is provided comprising a first cryogenic enclosure defined by at least one first wall, the first cryogenic enclosure being thermally connected to at least one first cold source. The system also comprises a second cryogenic enclosure defined by at least one second wall which extends at least partially facing the first wall, the second enclosure being contained inside the first enclosure and thermally connected to at least one second cold source. According to the invention, the refrigeration system comprises at least one first door in the first wall substantially facing a second door in the second wall, the first door and the second door being arranged such that the opening of the first door allows the opening of the second door.

In other words, the first door gives access to the second door.

Thus the first door and the second door are arranged such that the opening of the doors allows passage of an object from the outside of the first enclosure to the inside of the second enclosure, and vice versa.

This gives a refrigeration system which allows easy and rapid access to the interior of the second enclosure. The handling means are limited or non-existent, and the costs and time necessary for installing a device to be cooled in the second enclosure are reduced.

It is also possible to easily intervene for a maintenance operation inside the first enclosure (by opening only the first door) or inside the second enclosure (by opening the first and second doors).

Advantageously, the first door comprises a first frame on which a first panel is removably mounted, and wherein the second door comprises a second frame on which a second panel is removably mounted.

Further advantageously, the first enclosure and/or the second enclosure is a cylinder, the directrix curve of which is polygonal, preferably octagonal, the panels been flat.

Construction of the enclosures is simplified when the first panel defines a first side face of the first enclosure, the first panel being quadrangular in form and comprising a first width corresponding to a length of the segment of the directrix curve, and a first height which extends parallel to a generatrix of the cylinder.

Optionally, the system comprises a third door in the first wall and a fourth door in the second wall, substantially facing the third door.

The time and costs of installing a device in the second enclosure are further reduced when the first and second doors belong to a first lock chamber, and the third and fourth doors belong to a second lock chamber, the first lock chamber and the second lock chamber being configured to provide autonomous and independent access from the outside of the first enclosure to the inside of the second enclosure respectively for a first module and a second module, which both comprise a site configured to receive at least one quantum chip, a sensor, a superconductor element, a scanning tunneling microscope (STM) or another object to be cooled. When a lock chamber is used, loading and unloading can therefore be carried out without stopping operation of the system.

The thermal insulation of the enclosures is improved when the first wall and/or the second wall comprises a material blocking the passage of infrared radiation.

The time and costs of installing a device in the second enclosure are further reduced when the system comprises mechanical elements for connecting the first door to the second door.

Advantageously, the first door and/or the second door comprises a support for receiving an element to be cooled.

Construction of the system is simplified, and the methods of access to the doors are easier, when the first cryogenic enclosure comprises a first end face through which a first heat-transfer element of the first cold source extends, and/or the second cryogenic enclosure comprises a second end face through which a second heat-transfer element of the second cold source extends.

According to a preferred embodiment, the first wall comprises a first cylindrical structure with polygonal base on which a plurality of first panels are attached, at least one first panel being mounted removably on the first structure so as to constitute the first door, and/or the second wall comprises a second cylindrical structure with polygonal base on which a plurality of second quadrangular plates are attached, at least one second plate being mounted removably on the second structure so as to constitute the second door.

Optionally, in the case where the cylinders have a polygonal directrix curve, each face of the first and second walls may be removable and constitute a door.

The thermal losses of the system are reduced when the first cryogenic enclosure is contained in a first outer enclosure, or when the first outer enclosure is contained in a second outer enclosure.

The first outer enclosure may comprise a third door, and the second outer enclosure may comprise a fourth door, these doors being substantially opposite one another, like the first and second doors. The first and second outer enclosures may be cylinders with octagonal base, in which at least one face (or all faces) constitutes an access door.

Advantageously, the first cold source is configured to maintain a temperature between 2.5 Kelvin and 5 Kelvin, preferably substantially equal to 4 Kelvin inside the first enclosure, and the second cold source is configured to maintain a temperature between 0.6 Kelvin and 1.5 Kelvin inside the second enclosure.

Advantageously, the first outer enclosure is thermally connected to a third cold source, which is preferably configured to maintain a temperature between forty Kelvin and one hundred Kelvin inside the first additional enclosure.

According to an embodiment which is particularly well-suited to quantum computing, the object of the present invention is a refrigeration system for receiving independent modules containing quantum chips functioning at very low temperatures, comprising:

- a first cryogenic enclosure thermally connected to at least one first cold source, the first cryogenic enclosure and the first cold source being configured to allow a temperature below or equal to 150 K to be maintained inside the first cryogenic enclosure,
- a second cryogenic enclosure contained within the first cryogenic enclosure and thermally connected to at least one second cold source, the second cryogenic enclosure and the second cold source being configured to allow a temperature below or equal to 6 K to be maintained inside the second cryogenic enclosure,
- a plurality of independent thermal lock chambers each allowing autonomous and independent access from the outside of the first cryogenic enclosure to the inside of the second cryogenic enclosure for a module containing quantum chips.

In the sense of the present invention and in accordance with the definition given by the Larousse dictionary available online (2021—https://www.larousse.fr/dictionnaires/francais/sas/71049), the term "lock chamber" means a closed chamber or passage equipped with two doors or closing systems, in which the one can only be opened if the other is closed, and which allows passage from one environment to another while keeping these isolated from one another.

In certain embodiments, the invention proposes the use of a temperature sequence from ambient temperature to a temperature below 6 K, which allows energy efficiency. The presence of independent thermal lock chambers allows flexibility in the use of the system. In particular, it is possible to act on some of the modules containing quantum chips without affecting the other modules containing quantum chips.

In certain embodiments, the system according to the invention allows use on an industrial scale in which it is no longer a question of cooling a few $cm^2$ to 15 mK, and proposes an industrial solution allowing cooling of a much larger surface area of the order of 1 $m^2$ to several $m^2$.

Use of the first and second cryogenic enclosures allows creation of an environment at a temperature below or equal to 6 K which is able to receive independently multiple modules carrying quantum chips and in some cases one or more sub-Kelvin refrigeration devices. This allows an industrial solution to the development of quantum computers.

The refrigeration system according to the invention may also comprise one or more of the following characteristics considered individually or in any possible combination:

- the first cryogenic enclosure is thermally connected to the first cold source via a circuit able to transfer cold power from said first cold source to said first cryogenic enclosure; and/or
- the second cryogenic enclosure is thermally connected to the second cold source via a circuit able to transfer cold power from said second cold source to said second cryogenic enclosure; and/or
- the first cryogenic enclosure is contained in an outer enclosure which is sealed against ambient temperature; and/or
- all enclosures share a same pressure below or equal to $10^{-4}$ mbar and above or equal to $10^{-7}$ mbar, and the thermal lock chambers each allow autonomous and independent access from the outside of the outer enclosure; and/or
- the system comprises a third cryogenic enclosure contained inside the second cryogenic enclosure and thermally connected to at least one third cold source, wherein the third cryogenic enclosure and the third cold source are configured to allow a temperature below or equal to 2 K to be maintained inside the third cryogenic enclosure, and at least some of the thermal lock chambers allow autonomous and independent access from the outside of the first cryogenic enclosure to the inside of the third cryogenic enclosure for a module containing quantum chips; and/or the third cryogenic enclosure is thermally connected to the third cold source via a circuit able to transfer cold power from said third cold source to said third cryogenic enclosure; and/or the thermal lock chambers are configured to receive, from the outside of one of the cryogenic enclosures, modules containing quantum chips and the connections allowing communication with said quantum chips; and/or the thermal lock chambers are configured to receive, from the outside of the outer enclosure, modules containing quantum chips and the connections allowing communication with said quantum chips; and/or the refrigeration system also comprises inter-module connections allowing interconnection of quantum chips of different modules; and/or the refrigeration system also comprises an anti-radioactivity protection device around at least one of the first and/or second and/or third cryogenic enclosures, the anti-radioactivity protection device being configured to protect the interior of the refrigeration system from external radiation; and/or the devices and materials used inside the anti-radioactivity protection device are selected and manufactured so as to control the level of radioactivity inside the anti-radioactivity protection device; and/or the refrigeration system comprises a plurality of sub-Kelvin refrigeration devices arranged at least partly in the second cryogenic enclosure, each sub-Kelvin refrigeration device being configured to produce cold power so as to allow reaching of a temperature below or equal to 1 K, in particular below or equal to around one hundred millikelvin; and/or at least one of the independent thermal lock chambers allows access for a module containing quantum chips from the outside of the first cryogenic enclosure to at least one of the sub-Kelvin refrigeration devices; and/or at least some of the sub-Kelvin refrigeration devices are arranged in the third cryogenic enclosure; and/or the refrigeration system comprises at least one module and at least one refrigeration device, said at least one module containing quantum chips, said at least one refrigeration device being configured to produce cold power so as to allow reaching of a temperature below or equal to 1 K, in particular below or equal to around one hundred millikelvin, and at least one thermal lock chamber allowing access for said at least one module from the outside of the first cryogenic enclosure to the inside of the second cryogenic enclosure; and/or the refrigeration system comprises at least one module, said at least one module containing quantum chips and at least one refrigeration device, said at least one refrigeration device being configured to produce cold power so as to allow reaching of a temperature below or equal to 1 K, in particular below or equal to around one hundred millikelvin, and at least one thermal lock chamber allowing access for said at least one module from the outside of the first cryogenic enclosure to the inside of the second cryogenic enclosure; and/or at least one of the sub-Kelvin refrigeration devices is a $^3$He refrigeration device; and/or at least one of the sub-Kelvin refrigeration devices is an adiabatic demagnetization refrigeration device; and/or at least one of the sub-Kelvin refrigeration devices is a dilution refrigeration device; and/or the sub-Kelvin refrigeration device comprises at least one cryogenic pumping element situated in its working circuit; and/or at least two of the sub-Kelvin refrigeration devices are refrigeration devices of the same type which share a same cryogenic pumping element; and/or the cryogenic pumping element is situated inside the first cryogenic enclosure and outside the second cryogenic enclosure; and/or the cryogenic pumping element is situated inside the second cryogenic enclosure and outside the third cryogenic enclosure; and/or the cryogenic pumping element is situated inside the third cryogenic enclosure; and/or the sub-Kelvin refrigeration device is inside the third cryogenic enclosure; and/or each sub-Kelvin refrigeration device is configured to function at different sub-Kelvin temperatures.

Other features and advantages of the invention will become apparent on reading the following description of a non-limiting particular embodiment of the invention.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

FIG. 1 is a schematic cross-sectional view of a refrigeration system according to a first embodiment of the invention.

FIG. 2 is a schematic perspective view of the refrigeration system from FIG. 1.

FIG. 3 is a schematic, perspective, exploded view of a first enclosure of the refrigeration system from FIG. 1.

FIG. 4 is a detail, sectional view of an upright of the enclosure from FIG. 3.

FIG. 5 is a schematic, perspective, exploded view of a second enclosure of the refrigeration system from FIG. 1.

FIG. 6 is a schematic longitudinal sectional view of a refrigeration system according to a second embodiment of the invention.

FIG. 7 is a schematic, longitudinal sectional view of a refrigeration system according to a third embodiment of the invention; [FIG. 8] FIG. 8 is a detail, perspective view of a refrigeration system according to a fourth embodiment of the invention.

FIG. 9 is a detail, perspective view of a refrigeration system according to a fifth embodiment of the invention.

FIG. 10 is a schematic cross-sectional view of a refrigeration system according to a sixth embodiment of the invention.

FIG. 11 is a schematic, longitudinal sectional view of a refrigeration system according to a seventh embodiment of the invention.

FIG. 12 is a schematic cross-sectional view of a refrigeration system according to an eighth embodiment of the invention.

FIG. 13 is a schematic, longitudinal sectional view of a refrigeration system according to a ninth embodiment of the invention.

FIG. 14 is a schematic, perspective view of a second outer enclosure according to a tenth embodiment of the invention.

FIG. 15 is a schematic perspective view of a second outer enclosure according to an eleventh embodiment of the invention.

FIG. 16 is a schematic representation of a refrigeration system according to a twelfth embodiment of the invention applied to quantum computing;

FIG. 17 is a schematic representation of a refrigeration system according to a thirteenth embodiment of the invention.

FIG. 18 is a schematic representation of a refrigeration system according to a fourteenth embodiment of the invention.

FIG. 19 is a schematic, partial representation illustrating an exemplary structure of a sub-Kelvin refrigeration device able to be used in a refrigeration system according to the invention.

DETAILED DESCRIPTION OF THE INVENTION

With reference to FIGS. 1 to 5, the refrigeration system according to the invention, which is generally designated 1, comprises a first cryogenic enclosure 10 defined by a first wall 11. When the refrigeration system is running (active), the enclosure 10 is preferably under vacuum, i.e. at a pressure of less than a ten-thousandth of a millibar. The system 1 also comprises a second cryogenic enclosure 50 defined by a second wall 51 which extends facing the first wall 11. Similarly, during operation, the enclosure 50 is preferably under vacuum, i.e. at a pressure of less than a ten-thousandth of a millibar. As shown on FIG. 2, the enclosure 50 is contained inside the enclosure 10. The walls 11 and 51 are separated from one another by distance not equal to zero. The two enclosures 10 and 50 preferably share the same vacuum atmosphere.

The enclosure 10 is here a cylinder of primary longitudinal axis O10, the first directrix curve 12 which is octagonal. Here, the curve 12 defines a regular octagon. More precisely, the enclosure 10 comprises a first mechanically welded subframe 13. The subframe 13 has a first octagonal lower base 14, shown resting on a horizontal plane Ph in the illustrations of FIGS. 2, 3 and 5. The base 14 is produced using portions of metallic angle brackets assembled by welding, which form eight first segments 14.1 to 14.8 connecting the first eight corners 15.1 to 15.8 of the base 14 and thus define a regular octagon.

The subframe 13 also comprises a second upper base 16 identical to the base 14 and comprising eight second corners 17.1 to 17.8 connected together by second segments 18.1 to 18.8.

The corners 15.1 to 15.8 are connected respectively to corners 17.1 to 17.8 by eight first identical uprights 19.1 to 19.8. As shown in FIG. 4, the first upright 19.1 comprises a cross-section 19.10 of pentagonal form and has two adjacent outer edges 19.11 and 19.12 spaced apart by an angle $\alpha$ substantially equal to one hundred and thirty-five degrees. Similarly, the upright 19.2 has two outer edges 19.21 and 19.22, the upright 19.3 has two outer edges 19.31 and 19.32, the upright 19.4 has two outer edges 19.41 and 19.42, the upright 19.5 has two outer edges 19.51 and 19.52, the upright 19.6 has two outer edges 19.61 and 19.62, the upright 19.7 has two outer edges 19.71 and 19.72, and the upright 19.8 has two outer edges 19.81 and 19.82.

The subframe 13 thus defines eight rectangular frames:

- a frame 20 delimited by the segments 14.1 and 18.1 and by the edges 19.11 and 19.22;
- a frame 21 delimited by the segments 14.2 and 18.2 and by the edges 19.21 and 19.32;
- a frame 22 delimited by the segments 14.3 and 18.3 and by the edges 19.31 and 19.42;
- a frame 23 delimited by the segments 14.4 and 18.4 and by the edges 19.41 and 19.52;
- a frame 24 delimited by the segments 14.5 and 18.5 and by the edges 19.51 and 19.62;
- a frame 25 delimited by the segments 14.6 and 18.6 and by the edges 19.61 and 19.72;
- a frame 26 delimited by the segments 14.7 and 18.7 and by the edges 19.71 and 19.82;
- a frame 27 delimited by the segments 14.8 and 18.8 and by the edges 19.81 and 19.12.

The enclosure 10 comprises eight flat panels 30 to 37, respectively attached by bolting to the frames 20 to 27, in order to define eight first side faces of the enclosure 10. The panels 30 to 37 are here rectangular and all comprise a first width 11 corresponding to a length of the segment 14.1 to 14.8, and a first height H1 which extends parallel to a generatrix of the enclosure 10. Here, the height H1 is equal to the length of the uprights 19.1 to 19.8. The panels 30 to 37 are preferably made of a material blocking the infrared, such as copper.

The enclosure 10 comprises a lower end face 38 fixed to an edge of the base 14, and an upper end face 39 fixed to an edge of the base 16. The face 39 comprises connections to auxiliary equipment. The face 39 is connected via a braid 40 to a first cold source, here the second stage 41 of a pulsed tube (not shown) which allows thermalization of the enclosure 10.

The face 39 also comprises a first passage 39.1 for a pipe 42 connected to a first circulator or pump 43, a second passage 39.2 for a pipe 44 also connected to the circulator or pump 43, and a third passage 39.3 for a pipe 45 connected to a second pump 46. The circulator or pump 43 circulates a mixture of helium-3 and helium-4 in a set of reservoirs and pipework situated inside the enclosure 50 in order to constitute a He3/He4 dilution refrigerator. The cold source 41 is configured to maintain a temperature between 1.5 Kelvin and 5 Kelvin, preferably substantially equal to 4 Kelvin, inside the enclosure 10. The dilution refrigerator supplied by the circulator or pump 43 is configured to maintain a temperature between 0.6 Kelvin and 1.5 Kelvin inside the enclosure 50. The pump 46 is configured to maintain a pressure of less than or equal to one ten-thousandth of a millibar in the enclosure 10. In this example, the enclosure 10 is sealed, whereas the enclosure 50 is not and shares the same vacuum as the enclosure 10.

The enclosure 50 has a structure identical to that of the enclosure 10 and may resemble a reduced image of the enclosure 10, with a reduction factor along the axis O10 being greater than the reduction factor along an axis orthogonal to the axis O10. The enclosure 10 has a height greater than the height of the enclosure 50 and surrounds the enclosure 50.

As shown in FIG. 5, the enclosure 50 is a cylinder of longitudinal axis O10, the second directrix curve 52 of which is octagonal. Here, the curve 52 defines a regular octagon. The enclosure 50 comprises a subframe 53 having a third octagonal lower base 54, the corners 55 of which are connected to the corners 56 of a fourth octagonal upper base 57 by the uprights 58. The subframe 53 thus defines eight rectangular frames 60 to 67, to which are attached by bolting respectively eight flat panels 70 to 77 in order to define eight second side faces of the enclosure 50. The panels 70 to 77 extend respectively opposite the panels 30 to 37 and are preferably made of a material blocking the infrared, such as copper. The panels 70 to 77 are here rectangular and have a second height H2 which extends parallel to a generatrix of the cylinder. Here, the height H2 is equal to the length of the uprights 58. The panels 70 to 77 have a second width 12 substantially equal to the distance separating two adjacent corners 55. The enclosure 50 comprises an upper end face 59 on an edge of the base 57, which comprises a fourth passage 59.1 for the pipe 42 and a fifth passage 59.2 for the pipe 44, so as to connect the circulator or pump 43 to the He3/He4 dilution refrigerator situated inside the enclosure 50.

The panel 30 forms a first panel which makes a first door in the first wall 11 of the first enclosure 10. The frame 20 forms a first frame on which the first panel 30 is mounted.

The panel 70 forms a second panel which makes a second door in the second wall 51 of the second enclosure 50. The frame 60 forms a second frame on which the second panel 70 is mounted.

The end face 39 is here a first end face, and the end face 59 is here a second end face.

The second door is thus substantially opposite the first door.

The panel 31 forms a third panel which makes a third door in the first wall 11 of the first enclosure 10. The frame 21 forms a third frame on which the third panel 31 is mounted.

The panel 71 forms a fourth panel which makes a fourth door in the second wall 51 of the second enclosure 50. The frame 61 forms a fourth frame on which the fourth panel 71 is mounted.

The fourth door is thus substantially opposite the third door.

Any sealing elements which may be required to ensure the tightness of the enclosures are known in themselves and not described here.

In operation, when a device to be cooled is to be installed in the enclosure 50, or a maintenance intervention is required, the system is shut down and then the enclosure 10 is aerated by means of the pump 46. Then the panel 30 is unbolted from the frame 20 and removed. When the panel 30 has been removed, the panel 70 is accessible by reaching through the frame 20. The panel 70 is then unbolted and removed from the frame 60. The interior of the enclosure 50 is then accessible, and the device to be cooled may easily be installed there and where applicable connected to various connections, or maintenance may easily be performed. The panels 30 and 70 are then refitted respectively to the frames 20 and 60. Once the panels 30 and 70 are in place, the pump 46 applies a vacuum to the enclosure 10, the cold source 41 is activated to thermalize the enclosure 10, and the circulator or pump 43 is actuated to start the He3/He4 dilution refrigerator.

Elements which are the same as or similar to those described above carry an identical reference number to those in the description which follows of the second, third, fourth, fifth, sixth, seventh, eighth, ninth, tenth and eleventh embodiments of the invention.

According to a second embodiment shown on FIG. 6, the system 1 comprises a first tube 80 and a second tube 90 which are diametrically opposed relative to the axis O10 and are both welded to the walls 11 and 51. The first tube 80 comprises a first end 81 which protrudes from the wall 11 outside the enclosure 10. The end 81 comprises a flange 82 on which a closing plate 83 is bolted. The plate 83 has an internal thread 84 with a gas-tight pitch, in which a threaded pusher 85 is engaged. The second end 86 of the tube 80 protrudes inside the enclosure 50 and comprises a closing flap 87 which is returned to the closed position by means of a sprung hinge 88. The end 86 constitutes a support frame for the flap 87.

The tube 90 is identical to the tube 80 and, at its end 91 protruding on the outside of the enclosure 10, comprises a flange 92 to which a closing plate 93 is bolted. A threaded portion 95 is engaged in an internal thread 94 of the plate 93. The end 96 of the tube 90 opposite the end 91 comprises a closing flap 97 which is pivotably mounted by means of a sprung hinge 98. The end 96 constitutes a support frame for the flap 97.

The tube 80 constitutes a first lock chamber 89 which has a first door (plate 83) in the wall 11 and a second door (flap 87) in the wall 51.

The tube 90 constitutes a second lock chamber 99 which has a third door (plate 93) in the wall 11 and a fourth door (flap 97) in the wall 51.

In operation, when a device to be cooled—here a first module 100 comprising a first quantum chip 101 with pins 102—is to be installed in the enclosure 50, the plate 83 is removed and the module 100 is introduced into the tube 80. The plate 83 is repositioned and bolted. The volume of the lock chamber 89 it is then set under vacuum, then the module 100 is thermalized to the temperature of the enclosure 50. The pusher 85 is then actuated to cause the module 100 inside the tube 80 to advance in the direction of the enclosure 50 until the module 100 comes into contact with the flap 87. By further actuation on the pusher 85, the flap 87 is opened and the module 100 introduced into the enclosure 50. The flap 87 is closed again after the module 100 has been loaded in the enclosure 50. The module 100 may be connected to instrumentation 200 via a port 201 of the enclosure 50.

The lock chamber 99 functions identically to the lock chamber 89 for introduction of a second module 103 containing a second quantum chip 104.

This gives a refrigeration system 1 comprising a first lock chamber 89 and a second lock chamber 99, configured to provide autonomous and independent access to the inside of the enclosure 50 from the outside of the enclosure 10 respectively for the first module 100 and a second module 103. In fact in this embodiment, there is no need for evacuation of the enclosure 10 or stoppage of the He3/He4 dilution refrigerator in order to introduce a module 100 or 103 into the enclosure 50 from the outside of the enclosure 10. According to a third embodiment shown in FIG. 7, the plate 83 is bolted directly to the wall 11 and there is no sealed connection between the plate 83 and the flap 87 (no tube 80). The plate 83 has no internal thread 84 in order to retain a tight closure of the wall 11 by the plate 83. Similarly, the plate 93 is bolted directly to the wall 11 and there is no sealed connection between the plate 93 and the flap 97 (no tube 90). The plate 93 has no internal thread 94 in order to retain a tight closure of the wall 11 by the plate 93.

According to a fourth embodiment shown in FIG. 8, the panel 30 is connected to the panel 70 by a set of four spring-loaded actuators 110 made of fibre glass in order to limit the thermal conduction. Each actuator 110 has a rod 111 which is mounted slidingly in a casing 112 and on which a spring 113 exerts a thrust force in the direction from the panel 30 towards the panel 70.

The panel 30 is attached to the frame 20 by bolting. The panel 70 is held in place on the frame 60 by the thrust force exerted by the rods 111 on the panel 70.

Thus removal of the panel 30, which corresponds to opening of the first door in the wall 11, allows opening of the second door, namely removal of the panel 70.

According to a fifth embodiment shown in FIG. 9, the system 1 comprises a first shelf 120 which protrudes from the panel 30 towards the interior of the enclosure 10. A second shelf 121 protrudes from the panel 70 towards the interior of the enclosure 50.

The shelves 120 and 121 are used as supports for receiving an element to be brought to low temperature (of the order of one Kelvin for the shelf 121, and of the order of four Kelvin for the shelf 120).

According to a sixth embodiment shown in FIG. 10, the enclosure 10 is contained within a first outer enclosure 130 which provides a screen at fifty Kelvin. The enclosure 130 is here cylindrical and composed of two bolted half-cylinders, and is thermally connected by means of a conductive braid 47 to the first stage 48 of a pulsed tube (not shown). The first stage 48 is configured to maintain a temperature of between forty Kelvin and one hundred Kelvin inside the enclosure 130.

The enclosure 130 is also contained in the second outer enclosure 140 which provides a screen at ambient temperature (typically of the order of three hundred Kelvin). The enclosure 140 is here cylindrical and composed of two bolted half-cylinders 141 and 142. When the first outer enclosure 130 and/or the second outer enclosure 140 are present, the pump 43 and the pump 46 are preferably positioned outside the enclosures. The pump 43 is then connected to the interior of the second enclosure 50 by the pipes 42, 44. The pump 46 is configured to maintain a pressure of less than or equal to one ten-thousandth of a millibar in the device 1.

According to a seventh embodiment shown in FIG. 11, the enclosure 130 has a structure identical to that of the enclosure 50. The enclosure 130 is thus a cylinder of primary longitudinal axis O10 with a third wall 131, the third directrix curve 132 of which is octagonal. The enclosure 130 comprises a subframe 133 having a fifth octagonal lower base, the corners of which are connected to the corners of a sixth octagonal upper base by uprights 138.1 to 138.8. The subframe 133 thus defines eight rectangular frames 150 to 157, to which are attached by bolting respectively eight flat panels 160 to 167 so as to define eight third side faces of the enclosure 130. The panels 160 to 167 extend respectively opposite the panels 70 to 77.

The panel 160 forms a fifth panel which makes a fifth door (or first additional door) in the third wall 131 of the enclosure 130. The panel 160 is thus substantially opposite the panel 70, and the fifth door (first additional door) is thus substantially opposite the fourth door.

So when a device to be cooled is to be installed in the enclosure 50, or a maintenance intervention is required, the system 1 is shut down and then the enclosure 10 is aerated by means of the pump 46. The half-cylinder 142 is removed to gain access to the interior of the enclosure 140. The panel 160 is unbolted from the frame 150 and removed. When the panel 160 has been removed, the panel 30 is accessible by reaching through the frame 150, and the panel 30 is unbolted from the frame 20 and removed. When the panel 30 has been removed, the panel 70 is accessible by reaching through the frame 20. The panel 70 is then unbolted and removed from the frame 60. The interior of the enclosure 50 is then accessible. Thus the opening of the fifth door (first additional door) allows the opening of the first door.

Advantageously, and according to an eighth embodiment shown in FIG. 12, the enclosure 140 comprises a sixth door 143 (or second additional door) in the form of a sixth panel bolted onto the half-cylinder 142 in order to close a cutout 144.

The cutout 144 is substantially opposite the panel 160. Thus removal of the door 143 allows access to the panel 160 by reaching through the opening 143, and allows opening of the sixth door.

According to a ninth embodiment shown in FIG. 13, the enclosure 140 has a structure identical to that of the enclosure 130. The enclosure 140 is here a cylinder of longitudinal axis O10 with a fourth wall 145, the fourth directrix curve 146 of which is octagonal. The enclosure 140 comprises a subframe 147 having a fifth octagonal lower base, the corners of which are connected to the corners of a sixth octagonal upper base by uprights 148.1 to 148.8. The subframe 147 thus defines eight rectangular frames 170 to 177, to which are attached by bolting respectively to eight flat panels 180 to 187 so as to define eight fourth side faces of the enclosure 140. The panels 180 to 187 extend respectively opposite the panels 160 to 167.

The panel 180 forms a sixth panel which makes a sixth door in the fourth wall 145 of the enclosure 140. The panel 180 is thus substantially opposite the panel 160, and the sixth door is thus substantially opposite the fifth door.

So when a device to be cooled is to be installed in the enclosure 50, or a maintenance intervention is required, the system 1 is shut down and then the enclosure 10 is aerated by means of the pump 46. The panel 180 is unbolted from the frame 170 and removed. When the panel 180 has been removed, the panel 160 is accessible by reaching through the frame 170, and the panel 160 is unbolted from the frame 150 and removed. When the panel 160 has been removed, the panel 30 is accessible by reaching through the frame 150. The panel 30 is then unbolted and removed from the frame 20. When the panel 30 has been removed, the panel 70 is accessible by reaching through the frame 20. The panel 70 is then unbolted and removed from the frame 60. The interior of the enclosure 50 is then accessible.

According to a tenth embodiment shown in FIG. 14, the second outer enclosure 140 here is a monoblock cylinder 180 which is mounted around the first outer enclosure 130 by translation parallel to the axis O10. A first lower cover 181 and a second upper cover 182 are attached by bolting respectively to the lower end 183 and upper end 184 of the cylinder 180. The cover 182 is configured to allow passage of the necessary connections, preferably in a sealed fashion. For example, the cover 182 comprises sealed orifices for passage of cables and/or other equipment.

According to an eleventh embodiment shown on FIG. 15, the cylinder 180 comprises an upper cylinder portion 185 which is tightly attached/fixed, e.g. by bolting, to a lower cylinder portion 186.

Now the twelfth, thirteenth and fourteenth embodiments of the invention will be described, which are more particularly suitable for integration of a quantum computing system.

As shown on FIG. 16, the invention concerns a refrigeration system 210 configured to receive independent modules 220 containing quantum chips 222 functioning at very low temperatures.

In the sense of the invention, a very low temperature is a temperature below or equal to 1.8 K, preferably below or equal to 800 mK, preferably below or equal to 100 mK and above or equal to 2 mK.

In the sense of the invention, a quantum chip corresponds to an electronic system allowing production of qubits. A cold source may comprise at least one of: a cryogenic fluid bath, e.g. a liquid helium bath, a liquid nitrogen bath, a superfluid helium bath, a cryogenerator or cryocooler, a cycle gas refrigerator, or any other equipment or system allowing production of cold in particular at cryogenic temperatures, for example below −150° C.

The refrigeration system according to the invention is not limited to receiving modules containing quantum chips, but may receive sensors e.g. bolometers, which require very low temperatures.

As shown in FIG. 16, a refrigeration system 210 according to the invention comprises at least:

a first cryogenic enclosure 230, a second cryogenic enclosure 240, and a plurality of independent thermal lock chambers 250.

The first cryogenic enclosure 230 is thermally connected to at least one first cold source 232. The first cryogenic enclosure 230 and the first cold source 232 are configured to allow a temperature below or equal to 150 K, preferably below or equal to 77 K and above or equal to 50 K, to be maintained inside the first cryogenic enclosure.

Typically, the first cryogenic enclosure 230 is thermally connected to the first cold source 232 via a circuit 234 able to transfer cold power from said first cold source 232 to said first cryogenic enclosure 230. The thermal transfer between the first cold source 232 and the first cryogenic enclosure 230 may take place by a direct exchange of heat or by an indirect exchange of heat. For example, a heat transfer fluid cooled by the cold source is set in circulation in direct or indirect contact with the wall of the enclosure. Alternatively or cumulatively, the wall of the enclosure could be connected to a cold source by a mechanical heat-conducting connection (e.g. a copper braid or bar). Any other suitable heat transfer method may of course be envisaged.

According to a preferred embodiment of the invention, the first cold source 232 is based on liquid nitrogen or any other heat transfer fluid, and can supply a cold power of the order of 100 W to a MW for a temperature between 50 K and 150 K. For example, a cryogenic fluid of the first cold source (nitrogen or other, or a mixture) is set in circulation in thermal exchange with a heat exchanger or heat exchanging element connected to the walls of the first enclosure, or by gaseous thermal exchange with the volume of the first enclosure.

The second cryogenic enclosure 240 is inside the first cryogenic enclosure 230. Also, the second cryogenic enclosure is thermally connected to at least one second cold source 242. For example, as stated above, a heat transfer fluid cooled by the cold source is set in circulation in direct or indirect contact with the wall of the enclosure. Alternatively or cumulatively, the wall of the enclosure could be connected to a cold source by a mechanical connection (e.g. a copper braid or bar). The second cryogenic enclosure 240 and the second cold source 242 are configured to allow a temperature below or equal to 6 K, preferably below or equal to 5 K and above or equal to 2.8K, to be maintained inside the second cryogenic enclosure.

Typically, the second cryogenic enclosure 240 is thermally connected to the second cold source 242 via a circuit 244 able to transfer cold power from the second cold source 242 to the second cryogenic enclosure 240. The thermal transfer between the second cold source 242 and the second cryogenic enclosure 240 may take place by a direct exchange of heat or by an indirect exchange of heat.

According to a preferred embodiment of the invention, the second cold source 242 is based on liquid helium and provides a cold power of the order of 10 W to 100 kW for a temperature between 2.8 K and 6 K. The second cold source 242 is for example a refrigerator subjecting a cycle gas (such as helium or hydrogen or any suitable mixture) to a thermodynamic cycle in order to produce cold at one end.

Preferably, the second cold source 242 may be arranged outside the first cryogenic enclosure and supplies cold to the second enclosure via the circuit 244. Alternatively, the second cold source 242 may be arranged in the first cryogenic enclosure.

The refrigeration system according to the invention also comprises a plurality of independent thermal lock chambers 250. Each thermal lock chamber allows autonomous and independent access from the outside of the first cryogenic enclosure to the inside of the second cryogenic enclosure for a module 220. For example, each lock chamber comprises two doors and is movable between a sealed closed position allowing refrigeration of the module and an open position allowing loading and/or unloading of the module in the system. The module 220 contains for example quantum chips 222 allowing production of qubits.

Each thermal lock chamber 250 allows the module to have an external interface to the first cryogenic enclosure, typically at ambient temperature, comprising electrical and/or electronic and/or fluidic connections allowing respective connection of the electrical and/or electronic and/or fluidic functions of the module, for example the supply of fluids to a sub-K refrigerator integrated in the module 220.

In order to ensure independent function of each thermal lock chamber 250, each thermal lock chamber has a pre-evacuation device, an opening allowing insertion of the module 220, fluidic and/or thermal connections allowing creation of thermal links with the set of cold parts.

Advantageously, each module can therefore be managed independently; in particular, it is possible to act on one of the modules without affecting the other modules.

According to an embodiment of the invention, at least some—e.g. all—of the thermal lock chambers are configured to receive, from the outside of one of the cryogenic enclosures, modules containing quantum chips and the connections allowing communication with said quantum chips. The communication with the quantum chips may comprise the act of controlling said chips individually, reading and modifying the state of each quantum chip individually.

The refrigeration system according to the invention may also comprise a system of inter-module connections allowing mutual communication of the quantum chips of different modules, e.g. allowing mutual communication between quantum chips of the same type or different types (e.g. superconductor or Josephson-effect quantum chips and CMOS quantum chips). Advantageously, this may allow communication between chips of different modules. The connection system may for example comprise electrical or electronic connections, or connections by electromagnetic waves (e.g. microwaves or lightwaves) or any other suitable communication method.

In order to ensure optimum function, the system according to the invention preferably operates at very low pressure. Typically, the pressure inside the system according to the invention is below or equal to $10^{-4}$ mbar, for example below or equal to $10^{-5}$ mbar, preferably below or equal to $10^{-6}$ mbar and above or equal to $10^{-7}$ mbar.

As shown in FIG. 16, according to an embodiment of the invention, the refrigeration system according to the invention may comprise an outer enclosure 260 at ambient temperature, i.e. in contact with the ambient atmosphere surrounding system; for example, in an installation in a temperate country, this temperature could be between 0° C. and 40° C.

Advantageously, the outer enclosure 260 is sealed and allows the system according to the invention to be placed under vacuum. Typically, the first cryogenic enclosure 230 is contained inside the first outer enclosure 260. In this case, the first cryogenic enclosure 30 may not be sealed. The outer enclosure 260 may be connected to at least one vacuum pump 262 which allows the set of enclosures contained within the outer enclosure 260 to share a same pressure below or equal to $10^{-4}$ mbar, for example below or equal to $10^{-5}$ mbar, preferably below or equal to $10^{-6}$ mbar and above or equal to $10^{-7}$ mbar.

According to an alternative embodiment, the various enclosures of the system according to the invention may have different vacuum levels, for example if an exchange gas is to be introduced inside a single enclosure. In this case, the inner enclosures may be sealed and a lock chamber may be provided between each enclosure. According to such an embodiment, the system comprises valves and pipes to manage the vacuum and pumping.

In the embodiment comprising an outer enclosure 260, the thermal lock chambers 250 are configured so that each allows autonomous and independent access from the outside of the outer enclosure 260.

Also in the embodiment comprising an outer enclosure 260, the thermal lock chambers 250 are preferably configured to receive, from the outside of the outer enclosure, modules containing quantum chips and the connections allowing communication with said quantum chips.

The quantum chips may be highly sensitive to external radiation; in particular, their function may be hindered by this radiation, in particular by cosmic rays. It may therefore be useful to protect the quantum chips from this type of radiation, in particular when they are arranged inside the refrigeration system according to the invention.

Thus according to an embodiment of the invention, the refrigeration system also comprises an anti-radioactivity protection device around at least one of the first and/or second cryogenic enclosures and/or the outer enclosure, the anti-radioactivity protection device being configured to protect the interior of the refrigeration system from external radiation. For example, it is possible to use a lead screen around the quantum chips in order to protect them from external radiation.

Preferably, the materials used inside the anti-radioactivity protection device are selected and manufactured so as to control the level of radioactivity inside the anti-radioactivity protection device. For example, the lead used around the quantum chips may be archaeological lead, in which the intrinsic radioactivity is very low.

According to an embodiment shown in FIG. 17, in addition to the enclosures and cold sources described in connection with the embodiment of FIG. 16, the refrigeration system according to the invention may also comprise a third cryogenic enclosure 270.

The third cryogenic enclosure 270 is contained inside the second cryogenic enclosure 240 and thermally connected to at least one third cold source 272. For example, a heat transfer fluid cooled by the cold source is set in circulation in direct or indirect contact with the wall of the enclosure. Alternatively, the wall of the enclosure could be connected to a cold source by a mechanical heat-conducting connection, for example a copper braid or bar. The third cryogenic enclosure 270 and the third cold source 272 are configured to allow a temperature below or equal to 3 K, preferably below or equal to 2 K and above or equal to 1.8 K, to be maintained inside the third cryogenic enclosure.

The thermal transfer between the third cold source 272 and the third cryogenic enclosure 270 may take place by a direct exchange of heat or by an indirect exchange of heat. For example, a cryogenic fluid of the third cold source (for example helium) is set in circulation in thermal exchange with a heat exchanger or heat exchange element connected to the walls of the third enclosure, or by gaseous thermal exchange with the volume of the third enclosure.

According to a preferred embodiment of the invention, the third cold source 272 is for example based on liquid helium and provides a cold power between approximately 100 W and approximately 10 kW around 2 K, for example a cold power between 100 W and 7.2 kW, or a cold power between 100 W and 5 kW may be provided within the range of 1.6 K-2.2 K.

Typically, the third cold source is a helium refrigerator capable of lowering the helium temperature to 2 K or even 1.8 K by pumping over a refrigerated helium bath obtained by subjecting the helium (or other fluid or mixture) to a thermodynamic cycle producing cold at one end.

Preferably, the third cold source 272 may be arranged outside the first cryogenic enclosure, or outside the outer enclosure, and supply cold to the third enclosure via the circuit 274. Alternatively, the third cold source 272 may be arranged either inside the outer enclosure or inside the first cryogenic enclosure or the second cryogenic enclosure.

According to the embodiment shown in FIG. 17, at least some, e.g. all, the thermal lock chambers 250 allow autonomous and independent access from the outside of the first cryogenic enclosure, for example from the outside of the outer enclosure, to the inside of the third cryogenic enclosure, for a module containing quantum chips.

In order to ensure a very low operating temperature for the quantum chips, the refrigeration system according to the invention comprises at least one sub-Kelvin refrigeration device 280.

Each sub-Kelvin device allows production of a cold power so as to obtain a temperature below or equal to 1 K, in particular below or equal to around a hundred millikelvin.

As shown on FIG. 17, at least some, preferably all the independent thermal lock chambers allow access for a module containing quantum chips from the outside of the first cryogenic enclosure to at least one of the sub-Kelvin refrigeration devices.

Typically, at least some, preferably all the sub-Kelvin refrigeration devices are arranged in the second and/or for example the third cryogenic enclosure.

According to an embodiment, some of the elements of the sub-Kelvin refrigeration devices 280 may be arranged in the second cryogenic enclosure 240, while other elements of the sub-Kelvin refrigeration devices 280 are arranged in the third cryogenic enclosure 230.

According to a configuration of a refrigeration system not shown in the figures, it is possible that at least one sub-Kelvin refrigeration device produces a cold power allowing reaching of a temperature below or equal to 1 K in several modules containing quantum chips.

As shown on FIG. 18, according to an embodiment of the invention, each module containing quantum chips also contains at least one sub-Kelvin refrigeration device configured to produce cold power so as to reach a temperature below or equal to 1 K, in particular below or equal to around a hundred millikelvin. According to this embodiment, the sub-Kelvin refrigeration device is directly connected to the module containing the quantum chips to be cooled. According to a possible variant, some modules comprise a Kelvin refrigeration device while the remaining modules are cooled by the sub-Kelvin refrigeration modules installed in the second or third cryogenic enclosure.

All sub-Kelvin refrigeration devices allowing generation of a cold power of at least 1 μW at a sub-Kelvin temperature may be used in the refrigeration system according to the invention.

According to an embodiment of the invention, at least one, for example all, the sub-Kelvin refrigeration devices is a 3He refrigeration device. This type of refrigeration device is based on the principle of refrigeration by evaporation. A reduction in pressure above a helium bath allows the temperature of the helium bath to be lowered. Thus when using helium-3, it is possible to reach a temperature below or equal to 1 K, for example below or equal to around a hundred millikelvin.

According to an embodiment of the invention, at least one, for example all, the sub-Kelvin refrigeration devices is an adiabatic demagnetization refrigeration device. This type of device is based on reducing the entropy of a paramagnetic material, for example by subjecting the paramagnetic material to an external magnetic field, followed by adiabatic demagnetization, for example by withdrawing the external magnetic field, allowing a reduction in temperature of the paramagnetic material. The choice of paramagnetic material allows very low temperatures to be reached. To reach a sub-Kelvin temperature, alums may be used in which the magnetism is based on iron, chromium or cerium ions.

According to an embodiment of the invention, at least one, for example all, the sub-Kelvin refrigeration devices is a dilution refrigeration device.

An exemplary dilution refrigeration device is illustrated in FIG. 19.

The dilution refrigeration device illustrated in FIG. 19 comprises a working circuit 281 in the form of a loop containing a cycle fluid comprising a mixture of helium-3 (3He) and helium-4 (4He). This working circuit 281 comprises a mixing chamber 283, a boiler 285 and a transfer member 286 which are arranged in series and fluidically connected via a first set of pipes 282, 284.

The first set of pipes 282, 284 is configured to transfer cycle fluid from an outlet of the mixing chamber 283 to an inlet of the boiler 285 and from an outlet of the boiler 285 to an inlet of the transfer member 286.

The working circuit 281 comprises a second set of pipes 287 connecting an outlet of the transfer member 286 to an inlet of the mixing chamber 283.

The working circuit 281 comprises at least one first portion 288 for heat exchange between at least a part of the first set of pipes 282, 284 and the second set of pipes 287. The first heat exchange portion 288 is situated between the boiler 285 and the mixing chamber 283.

The device also comprises at least one cooling member 289 in heat exchange with the working circuit 281 and configured to transfer cold energy to the cycle fluid, i.e. to cool the cycle fluid.

According to an embodiment of the invention, at least one, for example all, the sub-Kelvin refrigeration devices may comprise at least one cryogenic pumping element situated in the working circuit.

An example of this embodiment is shown in FIG. 19 with a dilution refrigerator. As shown, the working circuit 281 of the dilution refrigerator may comprise a cryogenic pumping element 290 situated between the boiler and the transfer member.

This cryogenic pumping element 290 may be configured to pump the fluid, for example at a temperature above or equal to 0.5 K, for example above or equal to 1.8 K, and below or equal to 150 K, for example below or equal to 80 K. This cryogenic pumping element 290 comprises for example a turbomolecular pump or e.g. a Holweck pump or a centrifugal impeller pump, or any other technology or appropriate combination of technologies.

This cryogenic pumping element 290 is configured to pump fluid at a pressure above or equal to 0.01 mbar and below or equal to 100 mbar. For example, the cryogenic pumping element 290 is configured to pump fluid at around 0.1 mbar and at a low temperature of the order of 700 to 850 mK, in accordance with the functioning of the boiler 285. This cryogenic pumping element 290 is preferably configured to pump helium-3 at a pressure of around 0.1 mbar or less.

The presence of the cryogenic pumping element 290 allows an increase in the flow of cycle fluid and hence the cold power produced by the sub-Kelvin refrigeration device.

In an embodiment of the invention in which at least two sub-Kelvin refrigeration devices are refrigeration devices of the same type, for example two dilution refrigeration devices or two $^3$He refrigeration devices, it may be advantageous for these sub-Kelvin refrigeration devices to share a same cryogenic pumping element.

According to a preferred embodiment of the invention, when at least one, e.g. all, the sub-Kelvin refrigeration devices comprises a cryogenic pumping element, the pumping element is situated inside the second cryogenic enclosure and outside the third cryogenic enclosure. The sub-Kelvin refrigeration devices may be situated inside the third cryogenic enclosure 270.

When the refrigeration device according to the invention comprises several sub-Kelvin refrigeration devices, these sub-Kelvin refrigeration devices may be configured to function and different sub-Kelvin temperatures.

The invention has been described above with reference to embodiments shown on the figures, without limiting the general inventive concept.

Thus the doors may be opened successively in a lock chamber operating mode (the first door is closed before the second is opened), or not (the first door is left open and the second door is opened).

In a possible embodiment, the second door is opened automatically (the opening of the second door is triggered by the opening of the first door, with or without delay).

In another possible embodiment, the second door is opened at the same time as the first (the two doors may be mechanically linked).

Thus opening of the first door allows opening of the second door, in the sense that opening of the first door allows opening of the second door either directly after opening of the first door or after it has been closed again (and vice versa). In other words, the opening of the first door gives access to the second door (and vice versa).

This system of two (or more) doors in series allows several possible uses/configurations, for example:

- direct access from the outside to the inside for loading and/or maintenance (hence with loss of vacuum),
- access to the space between the doors for maintenance or loading at an intermediate temperature,
- access via a lock chamber, hence without loss of vacuum on the inside.

Of course, the invention is not limited to the embodiments described but covers any variant falling within the field of the invention as defined by the claims.

In particular:

- although here the first wall and the second wall are straight cylinders with polygonal base, the invention also applies to other types of wall such as e.g. curved walls used in cylinders with circular or other base;

although here the directrix curves of the first cylinder is octagonal, the invention also applies to other types of polygonal directrix curves, such as for example a square, rectangular, hexagonal or other curve;

although here the uprights have cross-sections of pentagonal form, the invention also applies to uprights of different cross-section such as e.g. triangular cross-section;

although here the panels are flat, the invention also applies to other panel configurations such as e.g. curved or polyhedral panels;

although here the frames are attached by bolting, the invention also applies to other ways of removably mounting a panel on a frame, such as e.g. screwing, clipping, magnetic fixing, a system of notches and tabs;

although here the frames and the associated panels are rectangular, the invention also applies to other types of frames and quadrangular panels such as e.g square frames and panels or those of parallelogram form;

although here the panels are quadrangular in form, the invention also applies to panels of different forms, such as e.g. triangular, circular or other form;

although here the panels have a height equal to that of the enclosure, the invention also applies to panels of height less than that of the enclosure;

although here the first end faces are fixed to the first subframe, the invention also applies to other means of fixing an end face to an edge of the enclosure, such as e.g. direct fixing to the upper portion of one or more panels;

although here the first enclosure is thermally connected to the second stage of a pulsed tube, the invention also applies to other types of first cold source such as e.g. a stage of a dilution refrigerator, a Peltier cell or gas expander, or any other type of cryogenic exchanger or cryocooler;

although here the first enclosure is thermally connected to the first stage of a pulsed tube, the invention also applies to other types of third cold source such as e.g. a Peltier cell or gas expander or any other type of cryogenic exchanger or cryocooler;

although here a pipe passes through the upper face of the first enclosure, the invention also applies to other thermal connection elements such as e.g. a thermo-conductive metallic braid. The connection may also be made on a lower end face of the first enclosure and/or second enclosure;

although here the second enclosure contains a dilution refrigeration device, the invention also applies to other types of sub-Kelvin refrigerators, such as e.g. Joule-Thompson type expansion refrigerators (helium-3 or helium-4), helium-3 refrigerators, or adiabatic demagnetization refrigerators;

although here the second enclosure and the first enclosure have identical structures, the invention also applies to enclosures of different structure, such as for example a first enclosure of hexagonal or square base and a second enclosure of hexagonal or square base;

although here the first and second doors are opposite one another, the invention also applies to other arrangements and configurations of doors in which the dimensions and relative positions allow opening of the second door while the first door is open;

although here the first and second lock chambers have been described in connection with a polygonal structure of the first and second enclosures, the invention also applies to lock chambers installed on other types of first and second enclosures, such as for example cylindrical enclosures similar to those of the prior art;

although here the first door and the second door are connected by spring-loaded actuators, the invention also applies to other types of mechanical means for connecting the first door to the second door, such as for example an elastomeric block, a welded or screwed connection;

although here the doors are solid, the invention also applies to doors comprising passages for cables or pipework intended to be connected to a device to be cooled which is placed in the second enclosure;

although here the doors comprise shelves protruding towards the inside of the enclosures, the invention also applies to other forms of supports for receiving an element to be cooled, such as e.g. a pole or hook;

although here the first and second outer enclosures have been shown in the form of two bolted half-cylinders, the invention also applies to other types of outer first and second enclosures, such as e.g. a first and second outer enclosure comprising a polygonal subframe and removable panels similar to those of the first and second enclosures;

although here the first and second enclosures are under vacuum, the invention also applies to a system in which the enclosures are not under vacuum, or a system in which the first and second enclosures share the same vacuum atmosphere or each have their own vacuum controlled separately by dedicated means. The first outer enclosure may also be under vacuum. The second outer enclosure may also be under vacuum. The first and second enclosures, and the first and second outer enclosures, may all share a same vacuum atmosphere or each have its own vacuum controlled separately. When the four enclosures share a same vacuum atmosphere, only the second outer enclosure is sealed;

although here the first wall and the second wall each comprise a single door, the invention also applies to walls containing more than one door, the doors in the first wall being substantially opposite those in the second wall;

although here the panels are made of copper, the invention also applies to any other material blocking the infrared, such as for example brass, gilded copper, polished gilded copper, aluminum or any other suitable material with an emissivity coefficient greater than 0.8 and ideally as close as possible to 1.

Preferably, the doors are controlled so as to form a lock chamber: each door can only be opened when the other door is closed. A mechanism may be provided which, when the second door is open and the first door closed, allows transport of a device to be cooled and contained in the conduit up to the second enclosure, and vice versa. The mechanism comprises for example a robotized arm contained in the second enclosure.

The embodiments described above are given merely as examples and are not intended to limit the scope of the invention, which is determined exclusively by the claims which follow.

In the claims, the word "comprising" does not exclude other elements or stages, and use of the indefinite article "a" or "an" does not exclude a plurality. The simple fact that different characteristics are listed in mutually dependent claims does not mean that a combination of these characteristics cannot be used advantageously. Finally, any reference used in the claims should not be interpreted as a limitation of the scope of the invention.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A refrigeration system comprising:

a first cryogenic enclosure defined by at least one first wall, the first cryogenic enclosure being thermally connected to at least one first cold source;

a second cryogenic enclosure defined by at least one second wall which extends at least partially facing the first wall, the second enclosure being contained inside the first enclosure and thermally connected to at least one second cold source;

wherein the refrigeration system comprises at least one first door in the first wall substantially facing a second door in the second wall, the first door and the second door being arranged such that the opening of the first door allows the opening of the second door, i.e. gives access to the second door, and the first cryogenic enclosure is contained within a first outer enclosure, and the first outer enclosure is contained within a second outer enclosure.

2. The refrigeration system as claimed in claim 1, wherein the first door comprises a first frame on which a first panel is removably mounted, and wherein the second door comprises a second frame on which a second panel is removably mounted, wherein the first enclosure and/or the second enclosure is a cylinder, the directrix curve of which is polygonal, wherein the first panel comprises a flat surface that is in a vertical orientation.

3. The refrigeration system as claimed in claim 2, wherein the first panel defines a first side face of the first enclosure, the first panel being quadrangular in form and comprising a first width corresponding to a length of the segment of the directrix curve, and a first height which extends parallel to a generatrix of the cylinder.

4. The refrigeration system as claimed in claim 1, comprising a third door in the first wall and a fourth door in the second wall substantially facing the third door.

5. The refrigeration system as claimed in claim 4, wherein the first door and the second door belong to a first lock chamber, and the third door and the fourth door belong to a second lock chamber, the first lock chamber and the second lock chamber being configured to provide autonomous and independent access from the outside of the first enclosure to the inside of the second enclosure respectively for a first module and a second module which both comprise a site configured to receive at least one quantum chip.

6. The refrigeration system as claimed in claim 1, comprising mechanical elements connecting the first door to the second door such that the opening of the first door initiates opening of the second door.

7. The refrigeration system as claimed in claim 6, wherein the mechanical elements comprise a plurality of spring-loaded actuators, each actuator comprising a rod mounted slidingly in a casing and a spring configured to exert a thrust force from the first door toward the second door, such that the second door is held in place on a second frame by the thrust force when the first door is closed and is released when the first door is opened.

8. The refrigeration system as claimed in claim 1, wherein the first cryogenic enclosure comprises a first end face through which a first heat-transfer element of the first cold source extends, and/or the second cryogenic enclosure comprises a second end face through which a second heat-transfer element of the second cold source extends.

9. The refrigeration system as claimed in claim 1, wherein the first outer enclosure comprises a first additional door arranged such that the opening of the first additional door allows the opening of the first door.

10. The refrigeration system as claimed in claim 9, wherein the second outer enclosure comprises a second additional door arranged such that the opening of the second additional door allows the opening of the first additional door.

11. The refrigeration system as claimed in claim 1, wherein the first outer enclosure is thermally connected to a third cold source.

12. The refrigeration system as claimed in claim 11, wherein the third cold source is configured to maintain a temperature between forty Kelvin and one hundred Kelvin inside the first additional enclosure.

13. The refrigeration system as claimed in claim 1, wherein the first cold source is configured to maintain a temperature between 2.5 Kelvin and 5 Kelvin, preferably substantially equal to 4 Kelvin inside the first enclosure, and the second cold source is configured to maintain a temperature between 0.6 Kelvin and 1.5 Kelvin inside the second enclosure.

14. The refrigeration system as claimed in claim 1, configured to receive independent modules containing quantum chips functioning at very low temperatures, wherein:

the first cryogenic enclosure and the first cold source are configured to allow a temperature below or equal to 150 K to be maintained inside the first cryogenic enclosure, the second cryogenic enclosure and the second cold source are configured to allow a temperature below or equal to 6 K to be maintained inside the second cryogenic enclosure, a plurality of first doors and second doors form independent thermal lock chambers each allowing autonomous and independent access from the outside of the first cryogenic enclosure to the inside of the second cryogenic enclosure for a module containing quantum chips.

15. The refrigeration system as claimed in claim 14, wherein the first cryogenic enclosure is thermally connected to the first cold source via a circuit able to transfer cold power from said first cold source to said first cryogenic enclosure.

16. The refrigeration system as claimed in claim 14, wherein the second cryogenic enclosure is thermally connected to the second cold source via a circuit that is configured to transfer cold power from said second cold source to said second cryogenic enclosure.

17. The refrigeration system as claimed in claim 14, wherein the first cryogenic enclosure is contained in an outer enclosure which is sealed against ambient temperature.

18. The refrigeration system as claimed in claim 17, wherein the set of enclosures share a same pressure below or equal to $10^{-4}$ mbar and above or equal to $10^{-7}$ mbar, and the thermal lock chambers each allow autonomous and independent access from the outside of the outer enclosure.

19. The refrigeration system as claimed in claim 14, comprising a third cryogenic enclosure contained inside the second cryogenic enclosure and thermally connected to at least one third cold source, wherein the third cryogenic enclosure and the third cold source are configured to allow a temperature below or equal to 2 K to be maintained inside the third cryogenic enclosure, and at least some of the thermal lock chambers allow autonomous and independent access from the outside of the first cryogenic enclosure to the inside of the third cryogenic enclosure for a module containing quantum chips.

20. The refrigeration system as claimed in claim 19, wherein the third cryogenic enclosure is thermally connected to the third cold source via a circuit able to transfer cold power from said third cold source to said third cryogenic enclosure.

21. The refrigeration system as claimed in claim 14, wherein the thermal lock chambers are configured to receive, from the outside of one of the cryogenic enclosures, modules containing quantum chips and the connections allowing communication with said quantum chips.

22. The refrigeration system as claimed in claim 17, wherein the thermal lock chambers are configured to receive, from the outside of the outer enclosure, modules containing quantum chips and the connections allowing communication with said quantum chips.

23. The refrigeration system as claimed in claim 14, also comprising inter-module connections allowing interconnection of the quantum chips of different modules.

24. The refrigeration system as claimed in claim 14, also comprising an anti-radioactivity protection device around at least one of the first and/or second and/or third cryogenic enclosures and/or the outer enclosure, the anti-radioactivity protection device being configured to protect the interior of the refrigeration system from external radiation.

25. The refrigeration system as claimed in claim 14, comprising a plurality of sub-Kelvin refrigeration devices arranged at least partly in the second cryogenic enclosure, each sub-Kelvin refrigeration device being configured to produce cold power so as to allow reaching of a temperature below or equal to 1 K, in particular below or equal to around one hundred milliKelvin.

26. The refrigeration system as claimed in claim 25, wherein at least one the independent thermal lock chambers allows access for a module containing quantum chips from the outside of the first cryogenic enclosure to at least one of the sub-Kelvin refrigeration devices.

27. The refrigeration system as claimed in claim 25, comprising a third cryogenic enclosure contained inside the second cryogenic enclosure and thermally connected to at least one third cold source, wherein the third cryogenic enclosure and the third cold source are configured to allow a temperature below or equal to 2 K to be maintained inside the third cryogenic enclosure, and at least some of the thermal lock chambers allow autonomous and independent access from the outside of the first cryogenic enclosure to the inside of the third cryogenic enclosure for a module containing quantum chips, wherein at least some of the sub-Kelvin refrigeration devices are arranged in the third cryogenic enclosure.

28. The refrigeration system as claimed in claim 14, comprising at least one module containing quantum chips, and at least one sub-Kelvin refrigeration device configured to produce cold power so as to allow reaching of a temperature below or equal to 1 K, in particular below or equal to around one hundred milliKelvin, and at least one thermal lock chamber allowing access for said at least one module from the outside of the first cryogenic enclosure to the inside of the second cryogenic enclosure.

29. The refrigeration system as claimed in claim 25, wherein at least one of the sub-Kelvin refrigeration devices is a 3He refrigeration device.

30. The refrigeration system as claimed in claim 29, wherein the sub-Kelvin refrigeration device comprises at least one cryogenic pumping element situated in its working circuit.

31. The refrigeration system as claimed in claim 30, wherein at least two of the sub-Kelvin refrigeration devices are refrigeration devices of the same type which share a same cryogenic pumping element.

32. The refrigeration system as claimed in claim 30, wherein the thermal lock chambers are configured to receive, from the outside of one of the cryogenic enclosures, modules containing quantum chips and the connections allowing communication with said quantum chips, wherein the cryogenic pumping element is situated inside the second cryogenic enclosure and outside the third cryogenic enclosure.

33. The refrigeration system as claimed in claim 32, wherein the sub-Kelvin refrigeration device is inside the third cryogenic enclosure.

34. The refrigeration system as claimed in claim 25, wherein at least one of the sub-Kelvin refrigeration devices is an adiabatic demagnetization refrigeration device.

35. The refrigeration system as claimed in claim 25, wherein at least one of the sub-Kelvin refrigeration devices is a dilution refrigeration device.

36. The refrigeration system as claimed in claim 25, wherein each sub-Kelvin refrigeration device is configured to function at different sub-Kelvin temperatures.

37. The refrigeration system as claimed in claim 1, wherein the first door is substantially vertically oriented and constitutes at least a portion of the first wall.

38. The refrigeration system as claimed in claim 1, wherein the second door is substantially vertically oriented and constitutes at least a portion of the second wall.

* * * * *